US012371961B1

(12) United States Patent
Gorhum et al.

(10) Patent No.: US 12,371,961 B1
(45) Date of Patent: Jul. 29, 2025

(54) INTENSIFYING SETTING TOOL FOR PACKER

(71) Applicant: Weatherford Technology Holdings, LLC, Houston, TX (US)

(72) Inventors: Justin D. Gorhum, Houston, TX (US); Frank D. Kalb, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/819,956

(22) Filed: Aug. 29, 2024

Related U.S. Application Data

(60) Provisional application No. 63/678,436, filed on Aug. 1, 2024.

(51) Int. Cl.
*E21B 23/06* (2006.01)
*E21B 23/04* (2006.01)

(52) U.S. Cl.
CPC ..... *E21B 23/06* (2013.01); *E21B 23/0416* (2020.05); *E21B 23/0421* (2020.05)

(58) Field of Classification Search
CPC ..... E21B 23/0416; E21B 23/042; E21B 23/06
See application file for complete search history.

(56) References Cited

U.S. PATENT DOCUMENTS 2,703,623 A * 3/1955 Baker ..... E21B 23/06 166/212
7,117,949 B2 10/2006 Doane et al.
7,814,978 B2 10/2010 Steele et al.
9,074,438 B2 7/2015 Caminari
9,388,665 B2 7/2016 Caminari
9,874,070 B2 1/2018 Hanson et al.
10,053,948 B2 8/2018 Hanson
10,519,747 B2 12/2019 Purkis
10,830,011 B2 11/2020 MacKenzie et al.
10,907,428 B2 2/2021 Luke et al.
11,441,375 B2 9/2022 Roane et al.
11,536,112 B2 12/2022 Clayton et al.
11,578,560 B2 2/2023 Zavala et al.
11,773,672 B2 10/2023 Kalb et al.
2018/0080303 A1 3/2018 Radtke et al.
2023/0407720 A1 12/2023 Moyes et al.

* cited by examiner

*Primary Examiner* — Robert E Fuller
(74) *Attorney, Agent, or Firm* — Cabello Hall Zinda, PLLC

(57) ABSTRACT

A setting tool disposed on tubing runs a packer into casing. During a setting process, a plug is engaged on a seat of an intensifying piston disposed in the tool. Tubing pressure applied against the seated plug moves the intensifying piston, which produces intensified pressure on fluid in a first volume of the intensifying piston communicated to a second volume of a setting piston. In response, the setting piston moves on the tool toward the packer's packing assembly. At some point in the process, the seated plug can be released from the seat. Additionally in the process, the second volume can fill with actuation fluid drawn through a fill valve from an annular space between the setting tool and the casing. The intensifying piston can then be reset as the actuation fluid is communicated from the second volume to the first volume.

23 Claims, 12 Drawing Sheets

INTENSIFYING SETTING TOOL FOR PACKER

CROSS-REFERENCE TO RELATED APPLICATIONS

This application claims the benefit of U.S. Provisional Appl. No. 63/678,436 filed Aug. 1, 2024, which is incorporated herein by reference in its entirety.

BACKGROUND OF THE DISCLOSURE

There are essentially two techniques used to set downhole packers in a wellbore. In a hydraulic technique, pressure is applied to energize the packer to engage in the wellbore. For example, a packer 30 as shown in FIG. 1A is hydraulically set in casing 12 with a hydraulic setting tool 20. The packer 30 can be a liner top packer, a tie-back packer, or the like. The setting tool 20 has a bushing 22 disposed on a splined shaft 24 and threaded to a lock sub 31 of the packer 30. The setting tool 20 also includes hydraulic pistons 26 and a setting sleeve 28. The packer 30 includes a mandrel 32 coupled to the lock sub 31. Opposing slips 34 and cones 36 are disposed on the mandrel 32 on either side of a packing element 38.

During setting operations, the setting tool 20 is coupled by the bushing 22 to the lock sub 31 and the packer's mandrel 32 to run the packer 30 in the casing 12. When setting depth is reached, hydraulic pressure communicated in the setting tool 20 actuates the pistons 26, which pushes the setting sleeve 28 downward to compress the slips 34, the cones 36, and the packing element 38 and to set the packer 30. To build up pressure, a sub 23 threaded into the splined shaft 24 accepts a ball, which seals off the tubing to build pressure in the pistons 26. Rotation of the setting tool 20 then unthreads the bushing 22 from the lock sub 31 so the hydraulic setting tool 20 can be retrieved.

In a mechanical technique, weight is set down to energize a packer to engage in a wellbore. For example, a packer 30 as shown in FIG. 1B is mechanically set using a mechanical setting tool 20'. This packer 30 can be a liner top packer and can be used with a separate liner hanger, which is set below a liner top packer, so the compression setting tool can then be used to set the liner top packer. As shown, the liner top packer 30 is coupled uphole of the separate liner hanger 35. The packer 30 has a packing element 38 disposed on the mandrel 32. The liner hanger 35 has slips 37*a* that are moved against cones 37*b* using a J-slot mechanism 39.

The packer 30 and liner hanger 35 are run in hole with the setting tool 20. When setting depth is reached, the liner hanger 35 is set in the casing 12 by operating the J-slot mechanism 39 and wedging the slips 37*a* with the cones 37*b* against the casing 12. At this point, rotation of the mechanical setting tool 20' unthreads the bushing 22 from the lock sub 31. The mechanical setting tool 20' is then lifted uphole inside the surrounding setting sleeve 28 until dogs 25 on the mechanical setting tool 20 bias outward beyond the distal end of the sleeve 28. Downhole movement of the mechanical setting tool 20' then engages the dogs 25 against the sleeve 28 so the sleeve 28 can be pushed against the packing element 38 on the packer 30 to set it against the casing 12. The mechanical setting tool 20' can then be removed.

Although these current techniques are successful, they may not be suitable for some implementations. For instance, setting in the hydraulic technique may use a single piston at high pressure or may use multiple pistons at lower pressure. If high pressure is to be used, there are often limits to the amount of pressure that can be applied based on the fracture pressure limit of the wellbore. Also, equipment in the running string may have pressure limit ratings, which can limit how much pressure can be applied to energize the packer. Even if lower pressure is to be used for multiple pistons in the hydraulic setting, the multi-piston setting tool requires an extended length, includes multiple leak paths, and has increased complexity.

Additionally, in the mechanical technique, there are often limits to the amount of weight that can be used due to available drill pipe lengths and weights. Additionally, any deviations in the wellbore and any buckling, drag, or the like of the drill pipe during set down can limit the amount of weight available to energize the packer.

The subject matter of the present disclosure is directed to overcoming, or at least reducing the effects of, one or more of the problems set forth above.

SUMMARY OF THE DISCLOSURE

A setting tool according to the present disclosure is used on tubing and is activated by tubing pressure applied behind a plug deployed to set a packer in casing. The packer defines a packer bore therein and has a packing assembly disposed thereon. The packing assembly is configured to engage in the casing. The setting tool comprises a tool body, a first piston, a second piston, a fill valve, and a seat.

The tool body is disposed on the tubing and is configured to removably engage with the packer. The tool body has a tool bore. The first piston is movably disposed in the tool bore and defines a first variable volume, which is configured to hold an actuation fluid. The first piston is moveable between a first actuator position and a second actuator position. The second piston is movably disposed on the tool body and defines a second variable volume, which is in fluid communication with the first variable volume and is configured to hold the actuation fluid. The second piston is moveable at least from a first setting position to a second setting position.

The fill valve is disposed on the tool body and is movable between a closed state and an opened state. The fill valve in the closed state is configured to prevent fluid communication of the actuation fluid out of the second variable volume. The fill valve in the opened state is configured to open fluid communication of the actuation fluid into the second variable volume. The seat is disposed on the first piston and is configured to engage the plug. The first piston is configured to move in response to the tubing pressure applied behind the plug engaged in the seat. The first piston in response to the movement is configured to intensify the tubing pressure as intensified pressure on the actuation fluid in the first variable volume communicated to the second variable volume. The second piston is movable on the tool body toward the packing assembly in response to the intensified pressure in the second variable volume.

The setting tool can comprise a biasing element engaged between the first piston and the tool body. The biasing element can be configured to urge the first piston to the first actuator position.

The first piston can comprise a sleeve disposed in the tool bore and having seals engaged therewith. The seals can seal the first variable volume defined between the sleeve and the tool bore.

The sleeve can define a flow bore therethrough in fluid communication with the tool bore, and the seat can be disposed in the flow bore of the sleeve.

The seat can be configured to release the plug in response to a predetermined threshold of the tubing pressure applied thereto. For example, the seat can comprise an expandable seat being configured to release the plug from engagement therewith in response to the predetermined threshold of the tubing pressure applied thereto.

The second piston can comprise a piston sleeve disposed on the tool body, and the piston sleeve can have an inner seal and an outer seal. The inner seal can be engaged with the tool body. The outer seal can be engaged with the tool body or engaged inside a portion of the packer or insides a polished bore receptacle disposed on the packer.

The second piston can comprise an outer sleeve disposed on the piston sleeve. The outer sleeve can be engaged with a movable portion of the packer, and the movable portion of the packer can be movable toward or away from the packing assembly.

The fill valve can be sealed between the piston sleeve and the tool body, and the inner seal and the fill valve can seal the second variable volume defined between the piston sleeve and the tool body.

The tool body can define one or more cross ports communicating the first and second variable volumes together.

The fill valve can comprise a ring disposed between an interior surface of the second piston and an exterior surface of the tool body. The second piston can be movable relative to the ring, and the ring can be movable between a sealed state and an unsealed state relative to the tool body.

The exterior surface of the tool body can define a stop and a recess. The ring in the sealed state can be moved toward the stop, and the ring in the unsealed state can be moved toward the recess.

The setting can comprise a biasing element disposed on the tool body and biasing the ring to the sealed state toward the stop.

The ring can comprise: an outer annular seal disposed on the ring and being sealed in sliding engagement with the interior surface of the second piston at least in response to the ring in the sealed state moved toward the stop; and an inner annular seal disposed on the ring, the inner annular seal being configured to seal in sliding engagement with the exterior surface of the tool body in response to the ring in the sealed state, the inner annular seal being configured to unseal from the exterior surface in response to the ring in the unsealed state moved toward the recess.

The fill valve can be a piston valve comprising: a ring disposed between an interior surface of the second piston and an exterior surface of the tool body, the ring being movable between a sealed state and an unsealed state relative to the tool body; a first annular seal disposed on the ring, the first annular seal being configured to seal in sliding engagement with the exterior surface in response to the ring in the sealed state, the first annular seal being configured to unseal from the exterior surface in response to the ring in the unsealed state; a second annular seal disposed on the ring and being configured to seal in sliding engagement with the interior surface; and a biasing element disposed in the tool body and biasing the ring toward the sealed state.

The fill valve can be a one-way valve comprising: a ring sealed between an interior surface of the second piston and an exterior surface of the tool body; a port defined through the ring from a first side to a second side, the second side in communication with the second variable volume; and a check element disposed in the port and being moveable between an opened position and a closed position, the check element in the closed position preventing fluid communication through the port from the second end to the first end of the ring, the check element in the opened position permitting fluid communication through the port from the first end to the second end of the ring.

The fill valve can be a sliding valve comprising: a ring disposed between an interior surface of the second piston and an exterior surface of the tool body; a first annular seal disposed on the ring and being configured to seal in sliding engagement with the exterior surface; a second annular seal disposed on the ring, the second annular seal being configured to seal in engagement with a seating portion on the exterior surface in response to the ring in the closed state, the second annular seal being configured to unseal from the seating portion in response to the ring in the opened state; and a biasing element disposed in the tool body and biasing the ring toward the closed state.

The setting tool can comprise a bonnet disposed on the tool body and holding a fluid volume in an annular space between the tool body and the casing. The fluid volume can be configured to hold an amount of the actuation fluid, and the fill valve can be disposed in fluid communication with the annular space.

The setting tool can comprise a temporary retainer configured to releasably retain the second piston in the first setting position. For example, the temporary retainer can comprise one or more shearable pins engaged between the second piston and the tool body.

The first piston can comprise a biasing element disposed in the first variable volume between a first shoulder of the tool bore and a second shoulder of the first piston. The biasing element can be configured to resist the movement of the second shoulder of the first piston toward the first shoulder.

The setting tool can comprise a releasable connection assembly disposed on the tool body. The releasable connection can be configured to releasably connect to the tool body.

A system according to the present disclosure is for use in casing. The system comprises a packer and a setting tool as disclosed above. The packer defines a packer bore therein and has a packing assembly disposed thereon. The packing assembly is configured to engage in the casing.

A method is disclosed of setting a packer in casing. The packer defines a packer bore therein and has a packing assembly disposed thereon. The packing assembly is configured to engage in the casing. The method comprises: running the packer into position in the casing by using a setting tool disposed on tubing; engaging a plug on an actuator seat in an intensifying piston in the setting tool; applying tubing pressure behind the plug engaged in the actuator seat; moving the intensifying piston in the setting tool from a first actuator position toward a second actuator position in response to the tubing pressure applied behind the plug; and intensifying the tubing pressure as intensified pressure on actuation fluid in a first variable volume of the intensifying piston communicated to a second variable volume of a setting piston; moving the setting piston toward the packing assembly of the packer in response to the intensified pressure in the second variable volume; releasing the tubing pressure behind the plug in the actuator seat; filling the second variable volume with the actuation fluid drawn through a fill valve from an annular space between the setting tool and the casing; and resetting the intensifying piston to the first actuator position with the actuation fluid communicated from the second variable volume to the first variable volume.

The method can comprise: setting the packer in the casing by actuating the packing assembly of the packer using the setting piston; releasing the plug from the actuator seat in response to a predetermined threshold of the tubing pressure; releasing a releasable connection of the setting tool to the packer; and retrieving the setting tool.

The method can comprise repeating the steps one or more times of applying the tubing pressure; moving the intensifying piston; intensifying the tubing pressure in response to the movement of the intensifying piston; and moving the setting piston.

The foregoing summary is not intended to summarize each potential embodiment or every aspect of the present disclosure.

BRIEF DESCRIPTION OF DRAWINGS

FIG. 5A illustrates portion of the setting tool during run in.

DETAILED DESCRIPTION OF THE DISCLOSURE

Figure 1A:
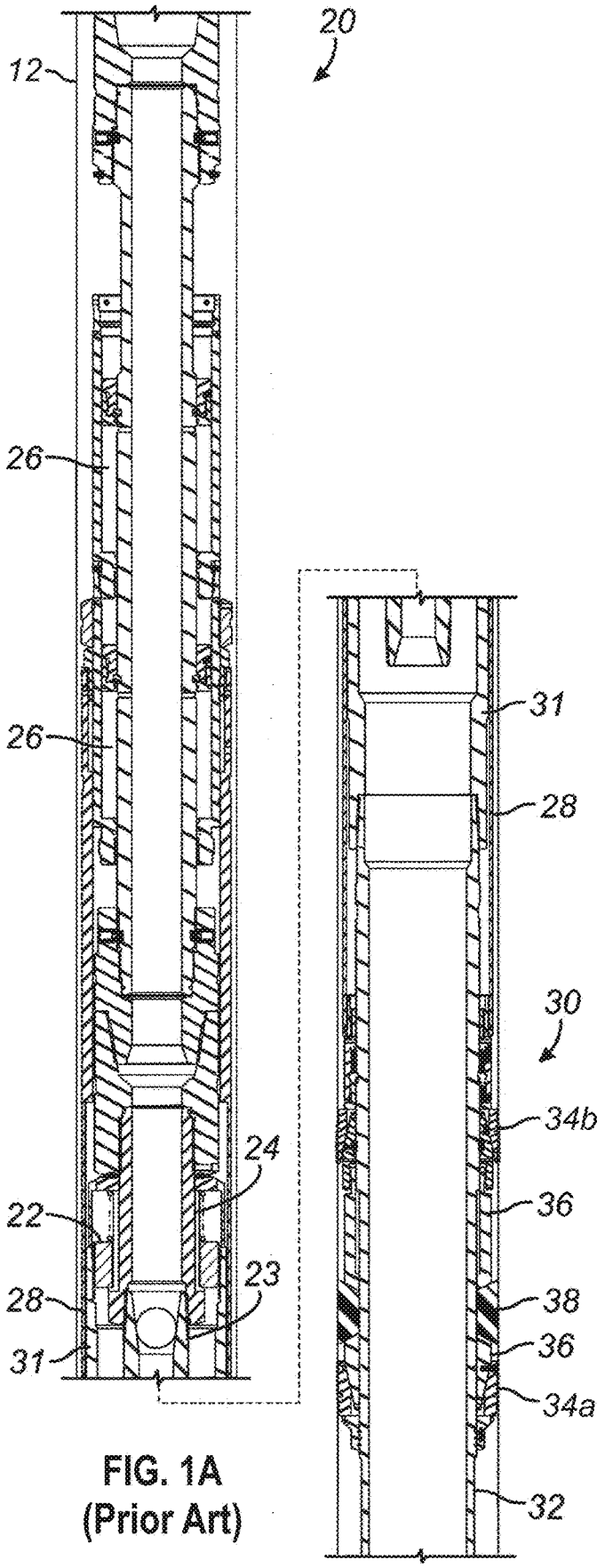
FIG. 1A (Prior Art)
FIG. 1A illustrates a prior art technique for hydraulically setting a packer.
Figure 1B:
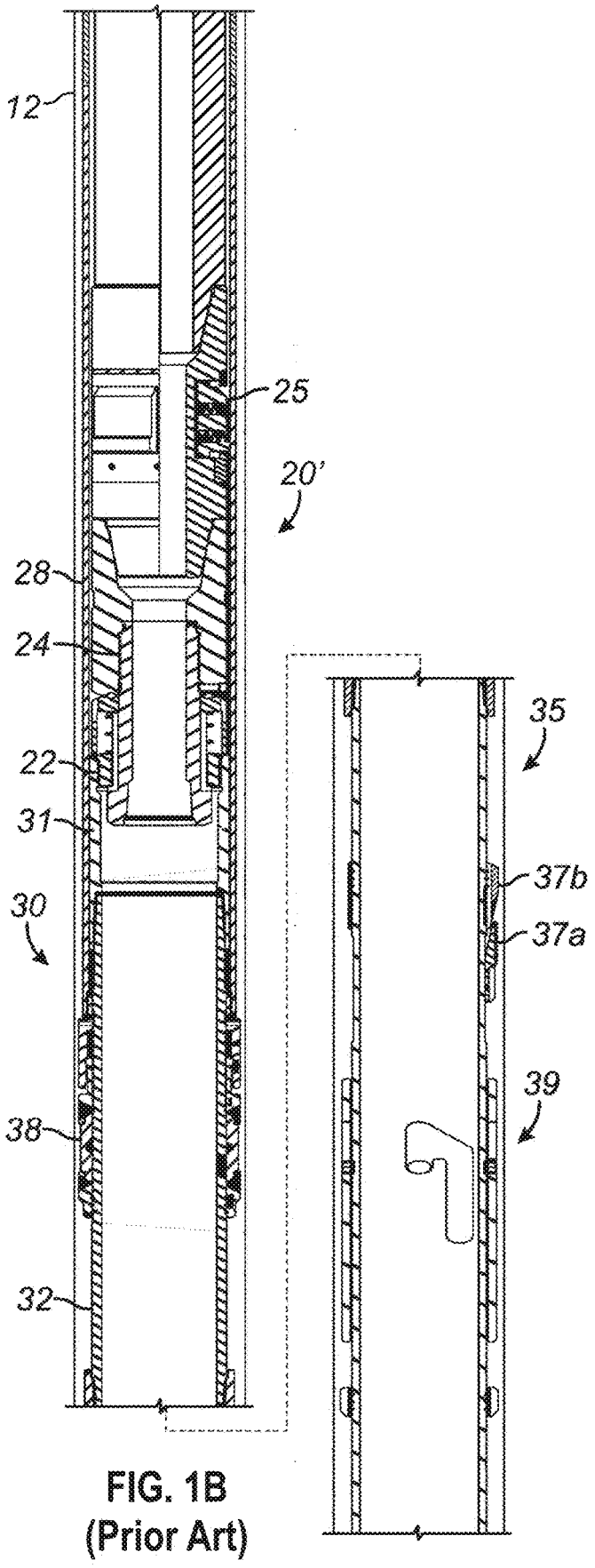
FIG. 1B (Prior Art)
FIG. 1B illustrates another prior art technique for mechanically setting a packer.
Figure 2A:
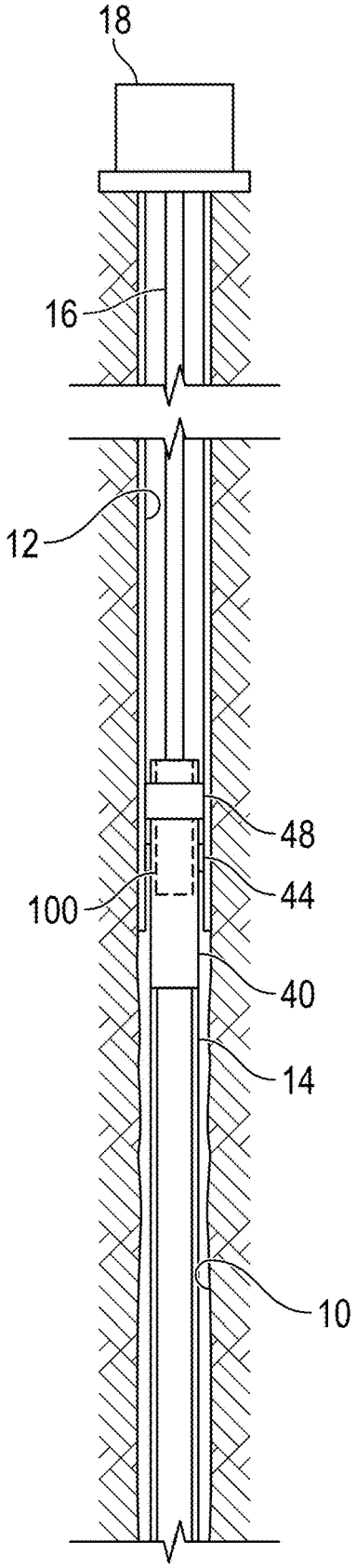
FIGS. 2A-2B illustrate schematic views of a setting tool deploying and setting a packer according to the present disclosure.

FIG. 2A illustrates a schematic view of a setting tool 100 deploying and setting a packer 40 according to the present disclosure. As shown in FIG. 2A, a borehole 10 has casing 12 in which the packer 40 is being deployed with the setting tool 100.

The packer 40 as disclosed herein can be a liner top packer run as a part of a liner hanger assembly. Additionally, the disclosed packer 40 can also be used as a tieback packer by allowing the liner to be extended to the surface or farther uphole in a tieback arrangement. As a liner top packer, the packer 40 in FIG. 2A is run as a part of a liner-hanger assembly to create a reliable liner-top seal between the host casing 12 and the liner string 14. Additionally, the liner top packer 40 can isolate formation pressures below the liner top from the casing 12 above, can isolate treating pressures or acid work below the liner top from the casing 12, can isolate fluids while cement sets, can mitigate gas migration, and can isolate lost circulation zones.

The setting tool 100 can also be used to deploy and set other types of packers, such as production or completion packers. Accordingly, the packer 40 can also be used as a tieback completion or production packer. Finally, the setting tool 100 can also be used to deploy and set other types of downhole tools, such as hold down subs and the like.

Figure 2B:
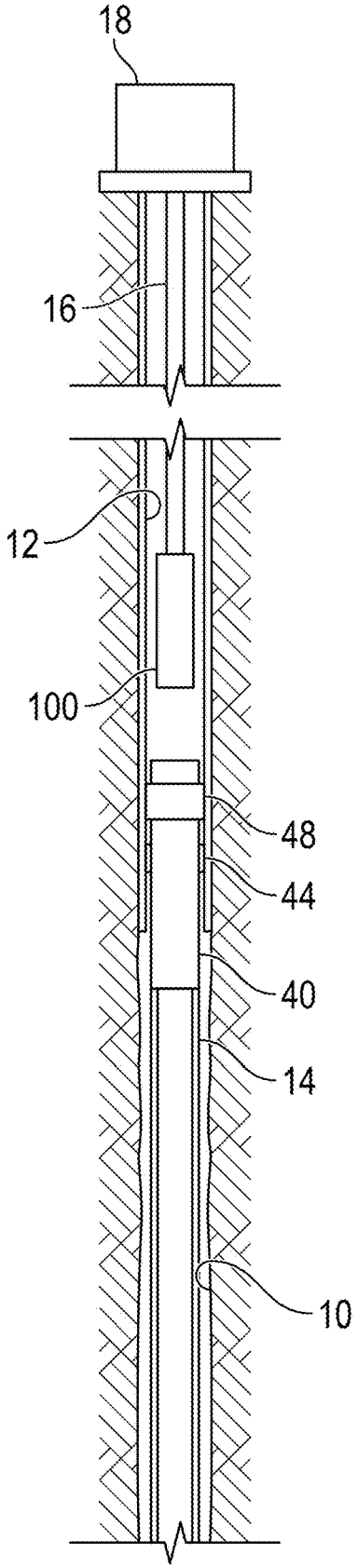

The setting tool 100 is connected to a running string 16 from the surface/rig deck/rig drawworks or the like (not shown). The running string 16 is run through a wellhead 18 and runs in the liner 14 and the packer 40 through the casing 12. When the proper depth is reached, the setting tool 100 activates the packer 40 by setting slips 44 and a packing element 48 so the liner 14 extends into the open borehole 10. To do this, the setting tool 100 uses tubing pressure communicated down the running string to set the packer 40. As shown in FIG. 2B, after setting the liner 14 and packer 40, the setting tool 100 is released from the packer 40 so additional operations can follow.

The setting tool 100 of the present disclosure allows the packer 40 to be run and set in downhole environments in which there may be limits to the amount of pressure that can be applied to energize the packer 40. For example, the setting tool 100 can be used in wellbores that have a fracture pressure limit. Also, the setting tool 100 can be used when downhole equipment has pressure ratings that can limit how much pressure can be applied to energize the packer 40. Preferably, the setting tool does not require an extended length, minimizes leak paths, and has decreased complexity. Finally, the setting tool 100 can allow the packer 40 to be run and set in downhole environments having a heavy, debris-laden drilling fluid, which would typically interfere with setting the packer 40.

Figure 3:
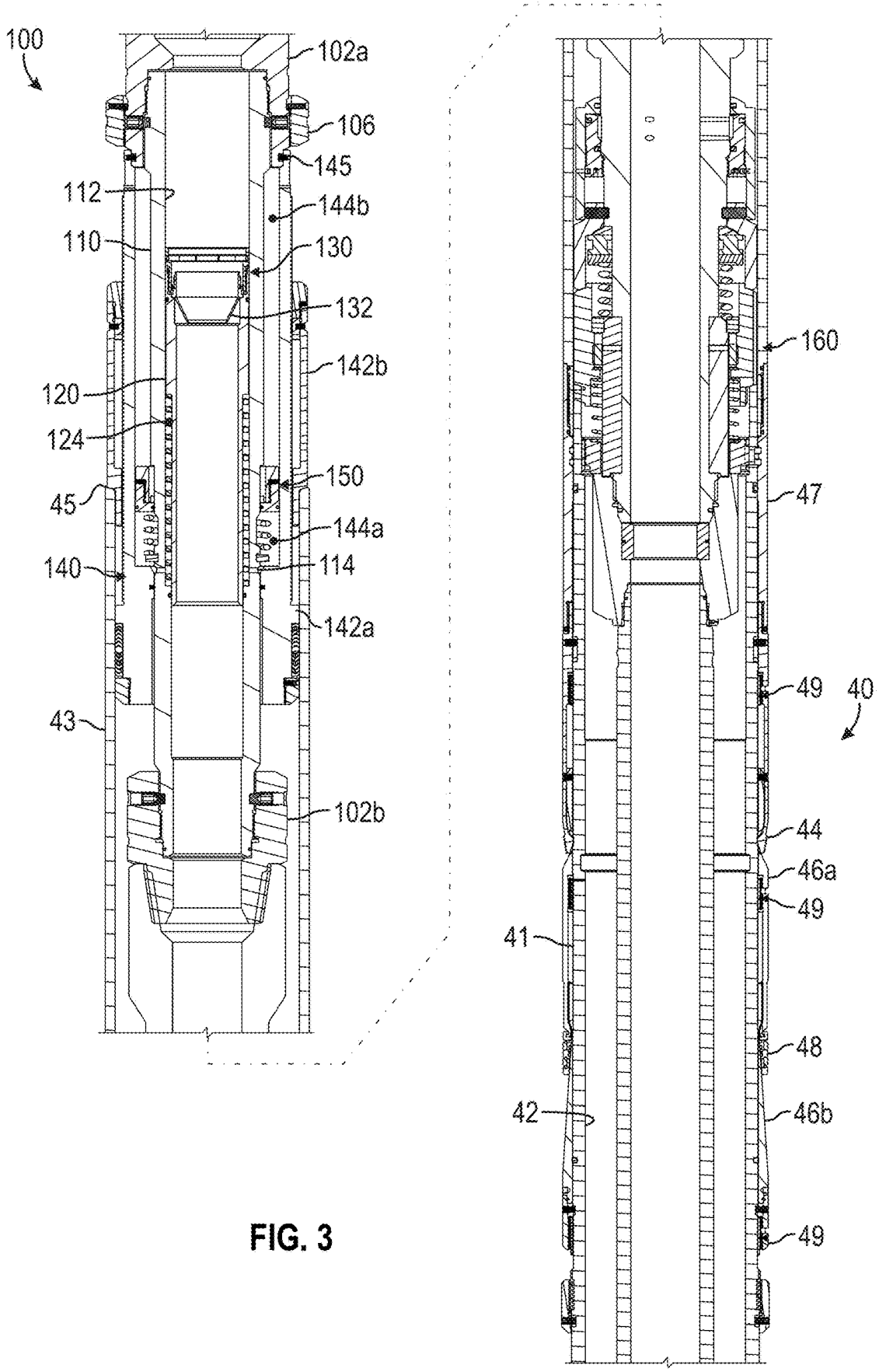
FIG. 3 illustrates a cross-sectional view of a setting tool according to the present disclosure for deploying and setting a packer.

FIG. 3 illustrates a cross-sectional view of the setting tool 100 according to the present disclosure for deploying and setting a packer 40. Briefly, the packer 40 has a housing 41 defining a housing bore 42. A polished bore receptacle 43 can be attached to the upper end of the packer 40. Although not shown in FIG. 3, the downhole end of the packer 40 can connect to a liner or other tubular (14).

The packer 40 can use a packing assembly, which can have several types of gripping and sealing features. In general, the packer 40 can include a packing assembly having one or more slips or gripping elements that can be pushed against one or more cone so that the slips can grip inside the casing (12). Additionally, the packing assembly of the packer 40 can include one or more packing elements to seal inside the casing (12).

In one example, the packing assembly of the packer can have opposing slips, which can ride up cones on both sides of a packing element having a compressible elastomeric sleeve. When compressed, the elastomeric sleeve expands outward and seals with the surrounding casing (12). Certain slips can be hanging slips to keep the housing 41 from moving downhole. Meanwhile, other slips can be used as hold-down slips to keep the housing 41 from moving back uphole due to pressure from below.

As shown here in the present arrangement, the packing assembly of the packer 40 includes slips 44 that can be pushed against a cone 46*a* so that the slips 44 can grip inside the casing (12) as hanging slips. The packing assembly of the packer 40 also includes a packing element 48 in the form of a swage ring, which can be expanded outward by when pushed against a cone 46*b*. Other typical arrangements can be used for the packing assembly of the packer 40.

Briefly, the setting tool 100 includes a tool body 110, an intensifying piston 120, an actuator seat 130, a setting piston 140, and a fill valve 150. The tool body (or mandrel) 110 is disposed on a tubing for running the setting tool 100. The tool body 110 has a tool bore 112 extending therethrough from an uphole end 102*a* to a downhole end 102*b*. The uphole end 102*a* can include a connection subcomponent that connects to the tubing string for running the setting tool 100. The downhole end 102*b* can include another connection subcomponent that connects to additional components discussed in more detail below. The tool bore 112 allows running fluid to pass through the setting tool 100 during run-in operations so circulation can be provided as the packer 40 (and the liner (14) if used) are run through the borehole (10).

The intensifying piston 120, which can be a sleeve, is disposed in the tool bore 112 of the tool body 110, and the actuator seat 130 is disposed on the intensifying piston 120. The intensifying piston 120, which can be a sleeve, is movably disposed in the tool bore 112 and defines a first variable volume 124. The first variable volume 124 is configured to hold an actuation fluid. In general, the intensifying piston 120 is moveable between a first actuator position and a second actuator position. During actuation as described below, the actuator seat 130 is configured to engage a plug or ball (not shown) deployed down the tubing. In response to the tubing pressure applied behind the plug B engaged in the actuator seat 130, the intensifying piston 120 moves and intensifies the tubing pressure as intensified pressure on the actuation fluid in the first variable volume 124.

The setting piston 140 is movably disposed on the tool body 110 and defines a second variable volume 144*a*, which is in fluid communication with the first variable volume 124. For example, the tool body 110 can define one or more cross ports 114 communicating the first and second variable volumes 124, 144*a* together. The second variable volume 144*a* is also configured to hold the actuation fluid.

During run in, a temporary retainer 145 releasably holds the setting piston 140 in a first setting position. The temporary retainer 145 can use one or more shearable pins, a shear ring, or other temporary connection engaged between the setting piston 140 and the tool body 110. During actuation as described below, the setting piston 140 is moveable at least from a first setting position to a second setting position. In particular, the intensified pressure communicated from the first variable volume 124 to the second variable volume 144*a* moves the setting piston 140 on the tool body 110 toward the packing assembly (44, 46*a-b*, 48) to set the packer 40.

As shown in particular in FIG. 3, the setting piston 140 disposed on the outside of the tool body 110 includes an inner piston 142*a* and an outer setting sleeve 142*b*. The inner piston 142*a* seals inside the polished bore receptacle 43 of the packer 40, and the outer setting sleeve 142*b* engages a shoulder 45 of the polished bore receptacle 43.

The fill valve 150 is disposed on the tool body 110 and is movable between a closed state and an opened state. In particular, the fill valve 150 is disposed in an annular space between the inner piston 142*a* and the tool body 110. In general, the fill valve 150 in the closed state is configured to prevent fluid communication of the actuation fluid from the second variable volume 144*a* to an annular area between the setting tool 100 and surrounding casing (12). Meanwhile, the fill valve 150 in the opened state is configured to open fluid communication of the actuation fluid from annular area into the second variable volume 144*a*.

In addition to these elements, the setting tool 100 includes a junk bonnet 106 disposed on the uphole end 102*a* of the tool body 110. The junk bonnet 106 can define a reserve volume 144*b* partially within and around the outside of the setting tool 100. This reserve volume 144*b* can be configured to hold an activation fluid separate and different from the borehole fluid during run in of the setting tool 100. To do this, the bonnet 106 can prevent other fluids from being introduced into the annular area between the setting tool 100 and the surrounding casing (12) when run downhole. The bonnet 106 can also prevent debris from entering the tieback polished bore receptacle 43.

The packer 40 and the setting tool 100 are shown generally in FIG. 3 during run-in. The setting tool 100 is configured to removably engage with the packer 40. For example, a lower end of the setting tool 100 can include a releasable connection assembly 160 to releasably engage inside the packer 40. The releasable connection assembly 160 can also prevent premature setting of the packer 40 during run in. Depending on how the setting tool 100 is configured to connect and disconnect with the packer 40, various types of mechanisms can be used, including a swivel, a bushing assembly, a threaded profile, a collet assembly, and other typical mechanisms used in the art.

During activation, the setting tool 100 remains connected inside the packer's housing 41. An outer setting sleeve 142*b* of the setting tool 100 is engaged against the shoulder 45 on the polished bore receptacle 43 of the packer 40. Meanwhile, the polished bore receptacle 43 and the connected latch sub 47 can move relative to the packer's housing 41.

As hinted to above, a plug or ball (not shown) is landed in the actuator seat 130 of the intensifying piston 120, and tubing pressure applied against the seated plug moves the intensifying piston 120 in the tool body's bore 112. Activation fluid disposed between the intensifying piston 120 and the tool bore 112 passes through cross ports 114 in the tool body 110 and acts inside a chamber of the setting piston 140. The fill valve 150 remains closed, as the inner piston 142*a* moves on the tool body 110 and pulls the outer setting sleeve 142*b*.

As actuation of the setting tool 100 continues, the outer setting sleeve 142*b* pushes against the polished bore receptacle 43, which pushes the latch sub 47 along the packer's housing 41. The latch sub 47 pushes against the slips 44, which push the cones 46*a* through a temporary retainer. The cones 46*a* push the swage seal 48, which rides up the cone 46*b* and expands outward to start sealing inside the casing (12). After the swage seal 48 is set inside the casing, the temporary retainer between the slips 47 and the cone 46*a* is sheared and the slips 44 can ride up the cones 46*a* on the packer's housing 41 and start gripping inside the casing (12). One or more body lock rings or other ratcheting mechanisms 49 prevent the reverse movement of the gripping and sealing achieved with the slips 44, the cones 46*a-b*, and the swage seal 48. The setting tool 100 can be released from the packer 40 once set by releasing the releasable connection assembly 160 to disengage from the housing 41.

Figure 4A:
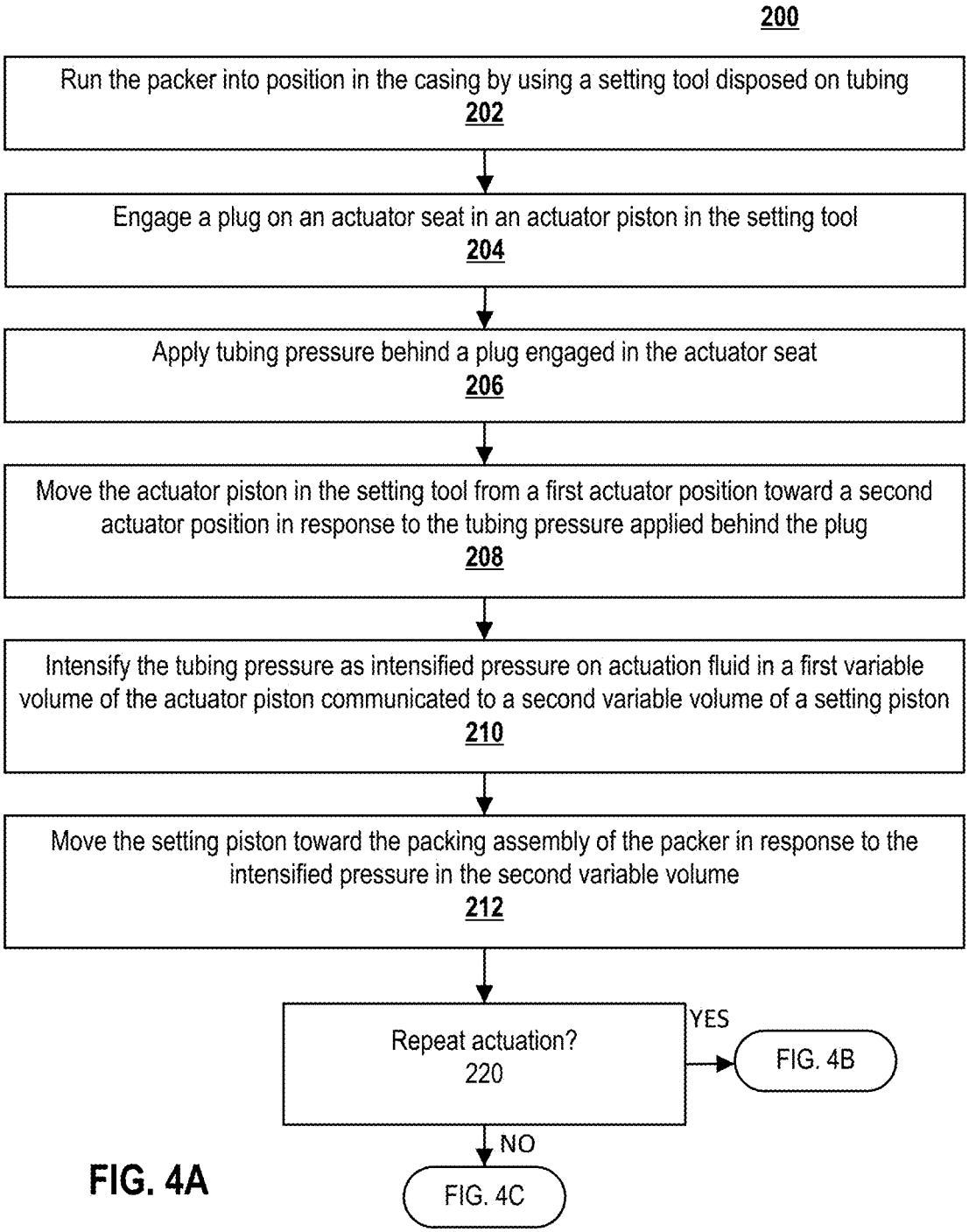
FIGS. 4A, 4B, and 4C illustrate a process for deploying and setting a packer with a setting tool according to the present disclosure.
Figures 4B, 4C:
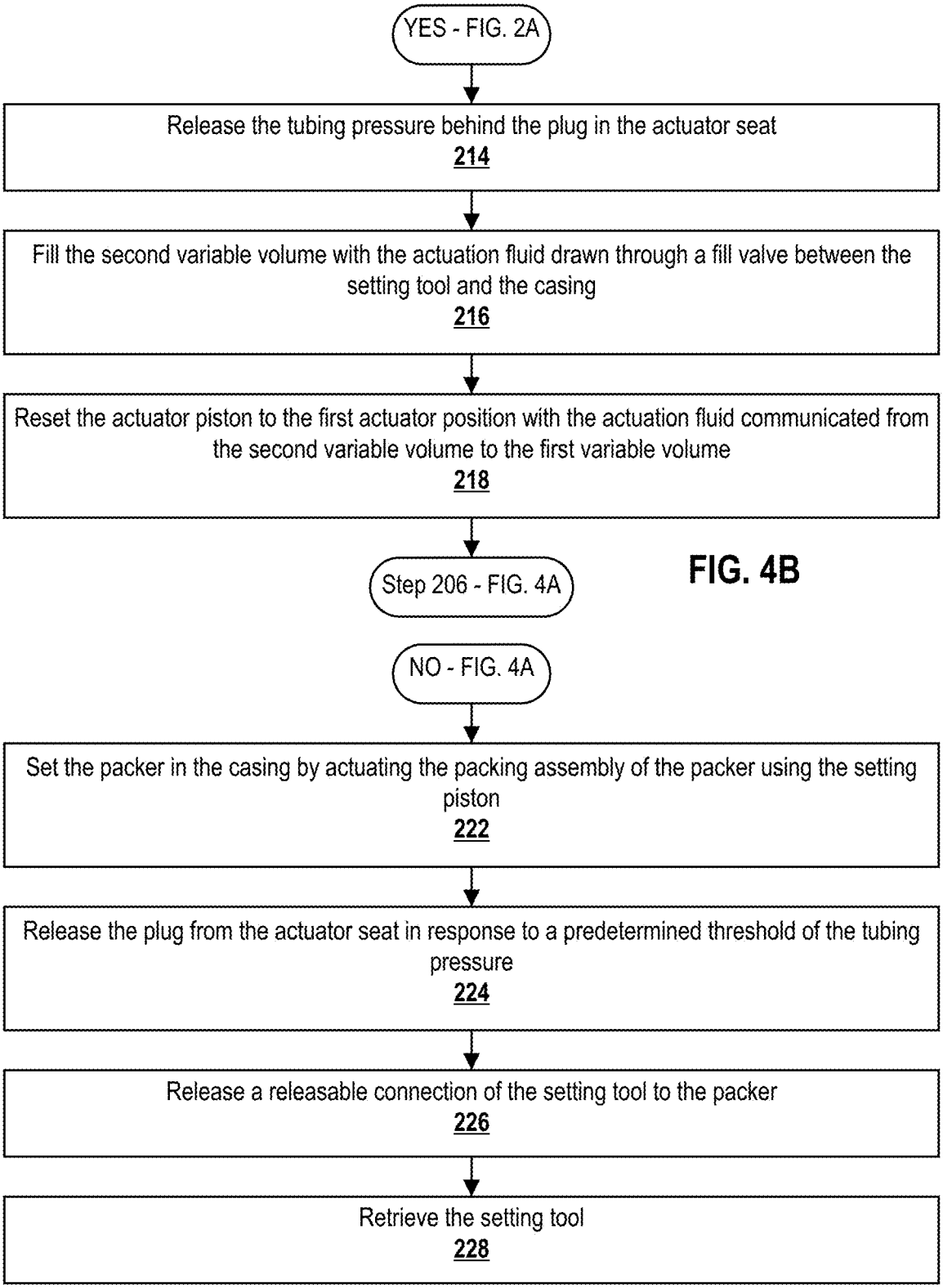

With an understanding of the components of the setting tool 100, discussion now turns to its operation. FIGS. 4A-4C illustrate a flowchart of an example process 200 of setting a packer 40 in casing (12) using a setting tool 100 as disclosed herein. Discussion of the process 200 will be described with reference to the previously described components as well as with reference to FIGS. 5A through 5H, which illustrate cross-sectional views of detailed portions of the setting tool 100.

Figure 5A:
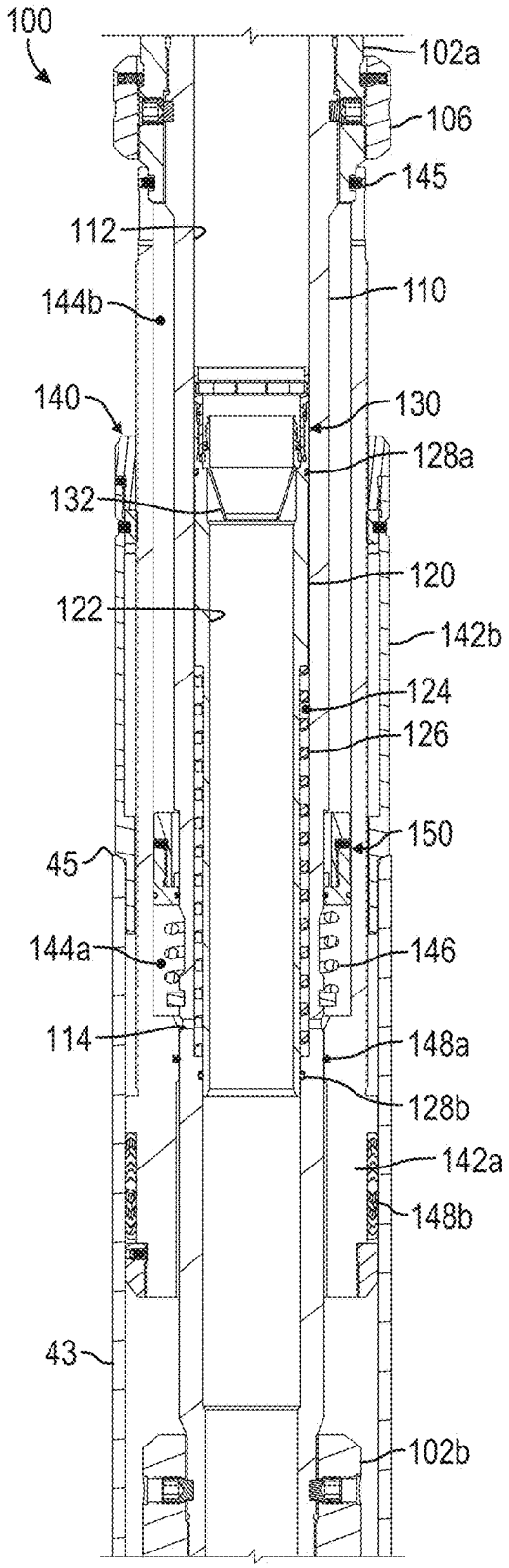

In the process 200 of FIG. 4A, the packer 40 is run into position in the casing by using the setting tool 100 disposed on tubing (i.e., running string (16)) (Block 202). As shown in FIG. 5A, the intensifying piston 120 is a sleeve disposed in the tool bore 112 on the tool body 110, and seals 128*a-b* on the piston 120 form a variable volume or chamber 124 with the tool body 110. A spring or other biasing element 126 disposed in the chamber 124 urges the piston 120 to an initial position as shown, such as when application of the tubing pressure is ceased or is absent. The actuator spring 126 can be disposed in the first variable volume 124 between a first shoulder of the tool bore 112 and a second shoulder of the intensifying piston 120. The actuator spring 126 can resist the movement of the second shoulder of the intensifying piston 120 toward the first shoulder and can return the intensifying piston 120 to the first position when tubing pressure is ceased or is absent.

The setting piston 140 is also a sleeve structure. For assembly purposes, the setting piston 140 can use two sleeve components, including an inner sleeve or inner piston 142*a* and including an outer setting sleeve 142*b*. An inner seal 148*a* on the inner piston 142*a* seals against the tool body 110, while an outer seal 148*b*, such as a pack-off seal, seals inside the polished bore receptacle 43. (In general, the outer seal 148*b* can be engaged elsewhere, such as inside a portion (i.e., housing) of the packer 40.) The seals 148*a-b* form a variable volume or chamber 144*a* with the tool body 110.

The outer setting sleeve 142*b* engages a shoulder 45 of the polished bore receptacle 43. (Other configurations using dogs, keys, profiles, and the like can be used to engage the outer setting sleeve 142*b* with the polished bore receptacle 43.) The outer setting sleeve 142*b* is affixed by a temporary retainer 145 to the tool body 110. For example, shear pins 145, shear ring, etc. temporarily affixes the outer setting sleeve 142*b* to the upper connection subcomponent 102*a*.

Figure 5B:
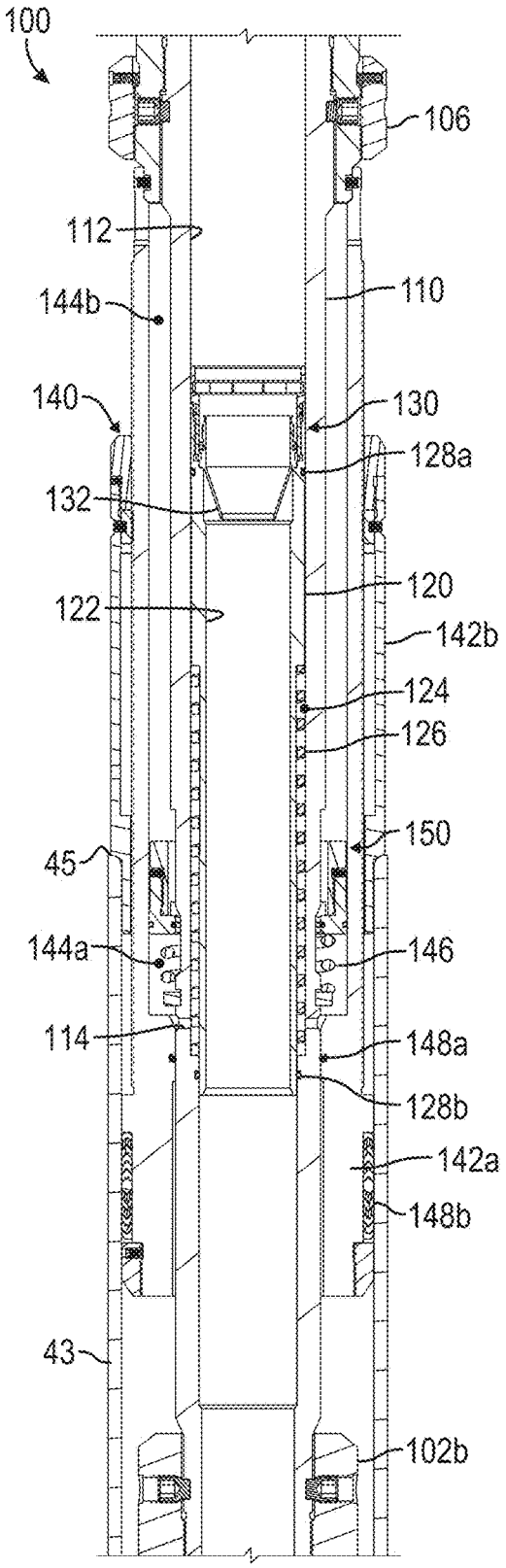
FIG. 5B illustrates the portion of the setting tool during run in as the fill valve balances hydrostatic pressure.

Initially during run-in, the cross ports 114 communicate between variable volumes or chambers 124, 144*a*, which are isolated from the surrounding wellbore by the fill valve 150 and the seal 148*a*, and pressure is balanced in the setting tool 100. As the setting tool 100 is run-in and as the hydrostatic pressure increases, the fill valve 150 as shown in FIG. 5B can open to balance the pressure in the chambers 124, 144*a* of the pistons 120, 140 with the hydrostatic pressure.

Figure 5C:
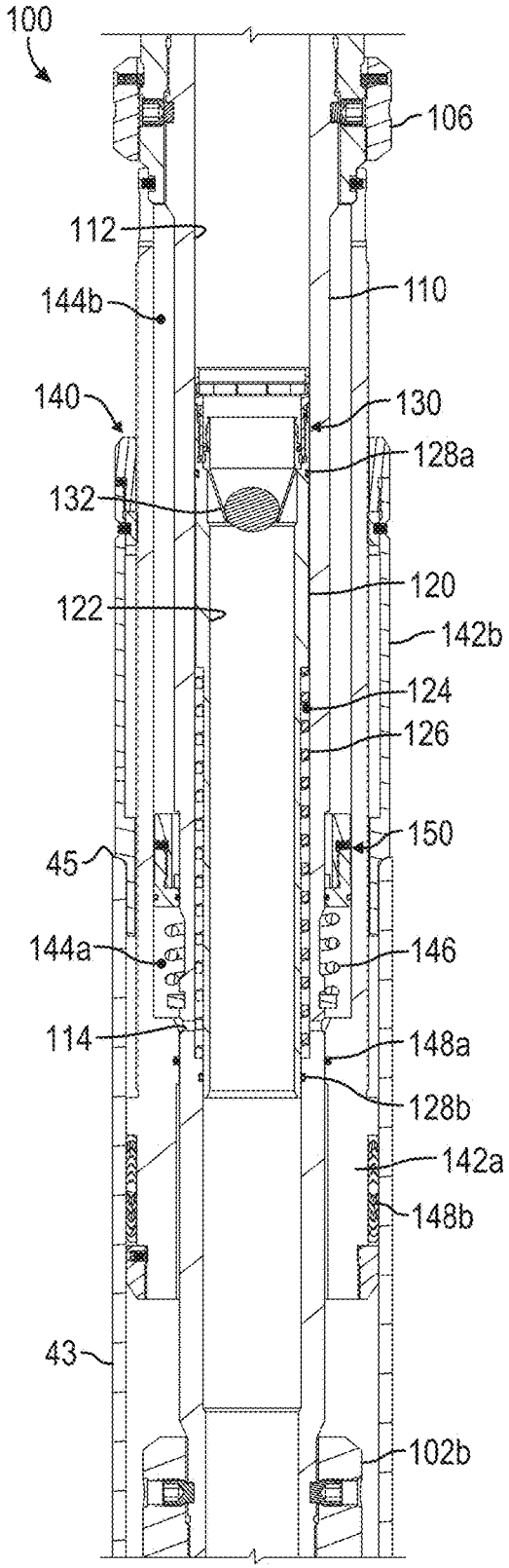
FIG. 5C illustrates the portion of the setting tool, showing the plug landed on the seat of the intensifying piston.

In the process 200, a plug (i.e., ball) B is deployed down the running string and engages on (lands on) the actuator seat 130 in the intensifying piston 120 in the setting tool 100 (Block 204). FIG. 5C illustrates the plug (i.e., ball) B landed on the actuator seat 130 in the intensifying piston 120.

In the process 200, tubing pressure is then applied behind the plug B engaged in the actuator seat 130 (Block 206). In response to the applied tubing pressure, the intensifying piston 120 moves in the setting tool 100 from a first actuator position toward a second actuator position (Block 208). The tubing pressure is intensified as intensified pressure on the actuation fluid in a first variable volume or chamber 124, which is communicated to the second variable volume or chamber 144*a* of the setting piston 140 (Block 210).

Figure 5D:
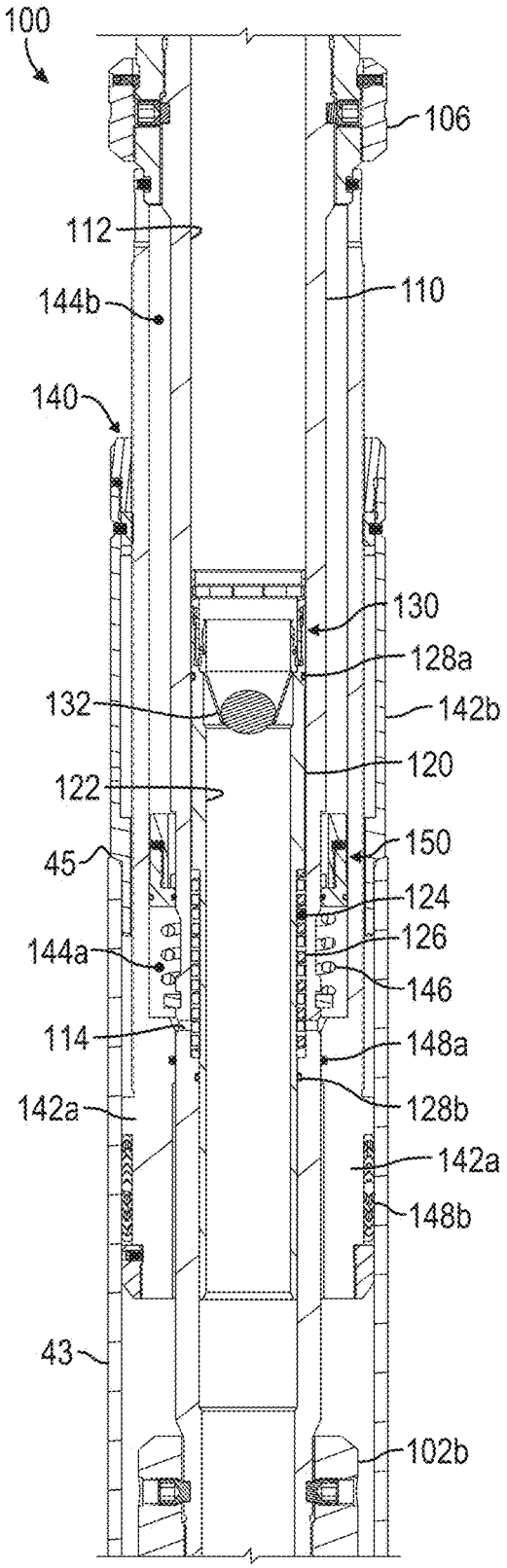
FIG. 5D illustrates the portion of the setting tool, showing tubing pressure applied to the seated plug to stroke the intensifying piston.

FIG. 5D illustrates the intensifying piston 120 stroked in the setting tool 100, with the intensified pressure communicated with the setting piston's chamber 144*a* of the setting piston 140. Pressure applied down the work string to the seated plug B causes the intensifying piston 120 to be stroked against the bias of a spring or other biasing element 126. Stroking of the intensifying piston 120 increases the pressure in the actuation fluid between the intensifying piston 120 and the tool body 110. The intensified pressure is communicated through the cross ports 114 to the setting piston's chamber 144*a*, where the intensified pressure acts against the piston surface on the inner piston 142*a* of the setting piston 140.

Figure 5E:
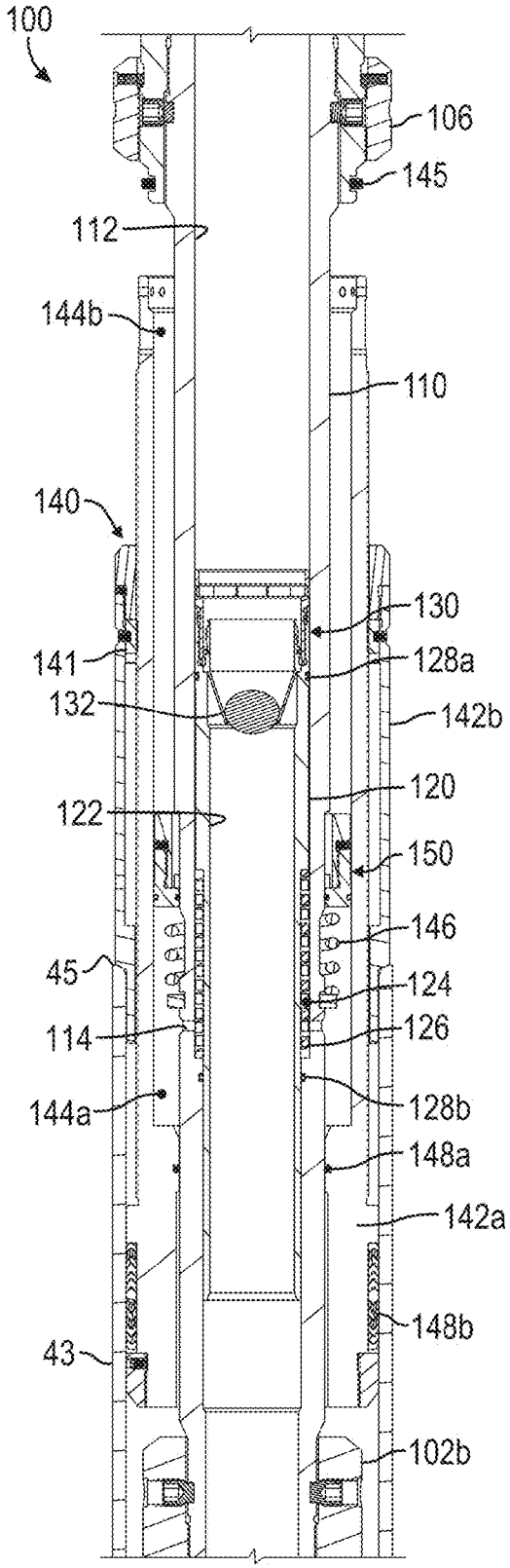
FIG. 5E illustrates the portion of the setting tool, showing the setting piston stroked to apply force to the packer through outer sleeves.

In the process 200, the setting piston 140 moves a distance on the tool body 110 toward the packer 40 in response to the intensified pressure in the setting piston's chamber 144*a* (Block 212). FIG. 5E shows the setting piston 140 stroked on the tool body 110, which pushes against the gripping and sealing features—i.e., packing assembly (44, 46*a-b*, 48) of the packer (40). The setting piston 140 now strokes and applies force to the packer (40) through the outer sleeves (43, 47) of the assembly. During the stroke, the outer setting sleeve 142*b* shears from of the shear pins 145.

The stroke of the intensifying piston 120 produces an amount of movement of the setting piston 140, which may be enough to set the gripping and sealing features (44, 46*a-b*, 48) of the packer (40). In some implementations, there may be a limit on the amount of tubing pressure that can be applied against the intensifying piston 120 so the setting piston 140 may only be stroked partially during the setting operation to set the packer (40). In this case, additional strokes of the intensifying piston 120 and resulting strokes of the setting piston 140 may be required. In other implementations, a longer stroke of the setting piston 140 may be required to fully set the packer (40).

In the present example of the setting tool 100 as shown in FIG. 5E, the tool body 110 does not have further length before the setting piston 140 reaches the lower connection subcomponent 102*b*. Depending on the implementation, a longer stroke may be needed to set the packer (40) so the tool body 110 may have a longer length than shown here to allow for a longer stroke distance of the setting piston 140.

In either of the above situations, the first stroke of the intensifying piston 120 may produce only a portion or segment of a full or complete stroke of the setting piston 140 required to set the packer (40) in the casing (12). Additional strokes may be necessary to advance the setting piston 140 additional amounts to set the packer 40. Complete setting of the packer (40) may be achieved once a predetermined threshold has been reached, such as a threshold of gripping and sealing achieved by the packer (40), which can be measured and determined using conventional techniques. In the process 200, a decision is made whether a repeated actuation is necessary (Decision 220).

If a repeated actuation is to be performed, the tubing pressure behind the plug B is released (Block 214), as shown in the additional process steps of FIG. 4B. As the actuator spring 126 moves the intensifying piston 120 to its initial position, actuation fluid is drawn from the annulus or annular area between the setting tool 100 and the casing (12) and passes through the now open fill valve 150 and into the setting piston's chamber 144*a* of the setting tool 100 (Block 216). The intensifying piston 120 eventually resets to its first actuator position with the actuation fluid communicated from the setting piston's chamber 144*a* to the intensifying piston's chamber 124 (Block 218).

Figure 5F:
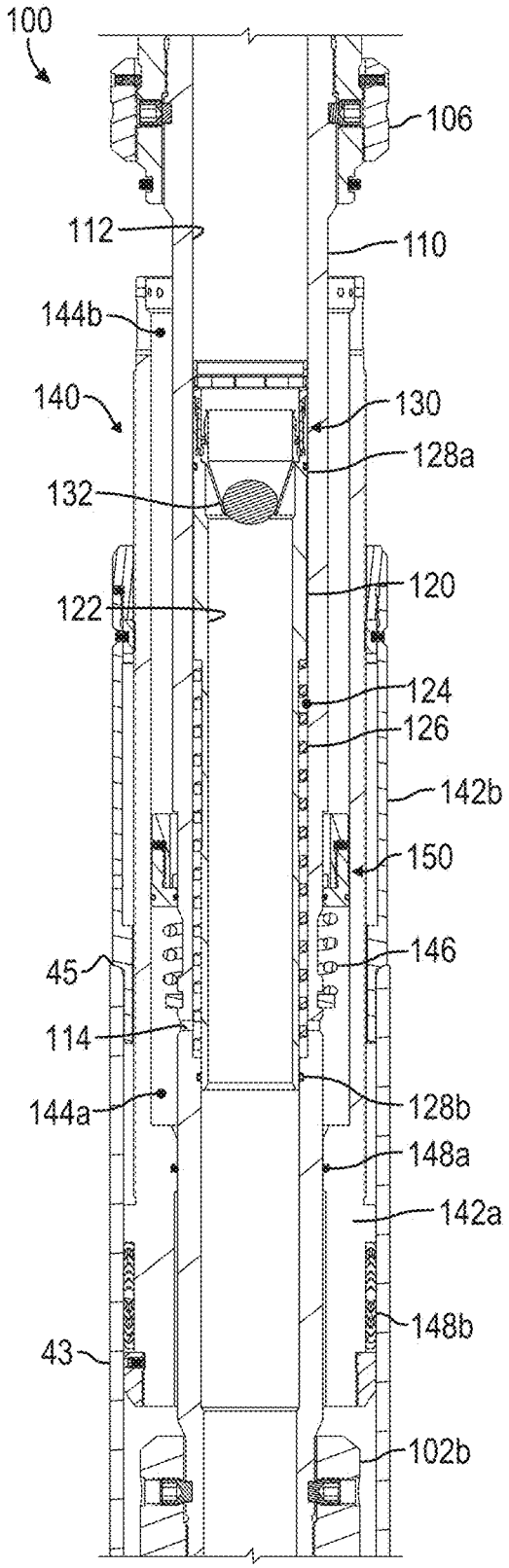
FIG. 5F illustrates the portion of the setting tool, showing the tubing pressure relieved and the intensifying piston reset.

FIG. 5F, for example, shows the setting tool 100 with the intensifying piston 120 returning to its initial position. As the actuator spring 126 moves the intensifying piston 120 to its initial position, the intensifying piston's chamber 124 expands and draws the actuator fluid in the setting piston's chamber 144*a* through the cross ports 114. The advance of the setting piston 140 is held by a body lock ring or other ratcheting mechanism so the setting piston 140 does not move away from its advance position and the volume of the setting piston's chamber 144*a* does not decrease. (For example, the advance of the setting piston 140 can be held by one or more body lock rings 49 on the packer 40 as in FIG. 3. Other configurations can be used. For instance, a body lock ring (not shown) can be used on the setting tool 100 to hold the advance of the setting piston 140. Such a body lock ring can be positioned, for example, between the inner piston 142*a* and the tool body 110.)

Figure 5G:
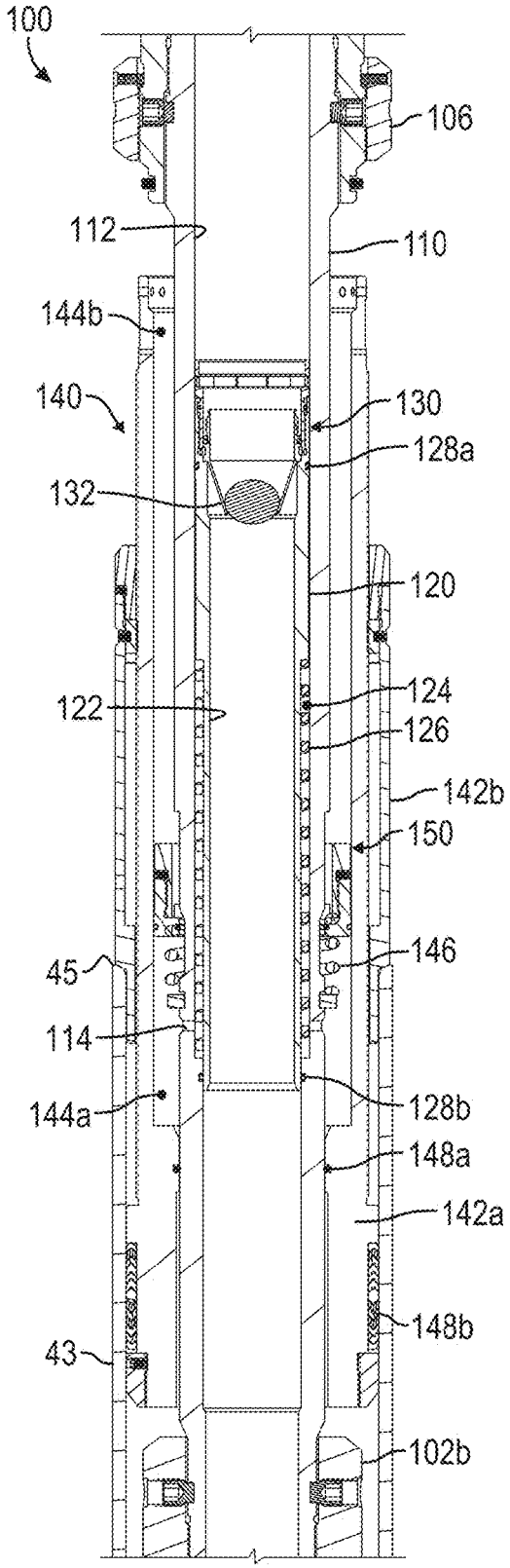
FIG. 5G illustrates the portion of the setting tool, showing the fill valve opened to refill the setting piston volume with actuation fluid.

As shown in FIG. 5G, actuation fluid can be drawn into the setting piston's chamber 144*a* through the fill valve 150, which opens in response to the pressure differential. As shown in FIG. 5G, the fill valve 150 of the setting piston 140 comes off seat, and the volume of the setting piston's chamber 144*a* refills with the actuation fluid. Opening of the fill valve 150 occurs while the intensifying piston 120 is resetting, and the actuation fluid can pass through the cross ports 114 and into the intensifying piston's chamber 124 as it expands.

Figure 5H:
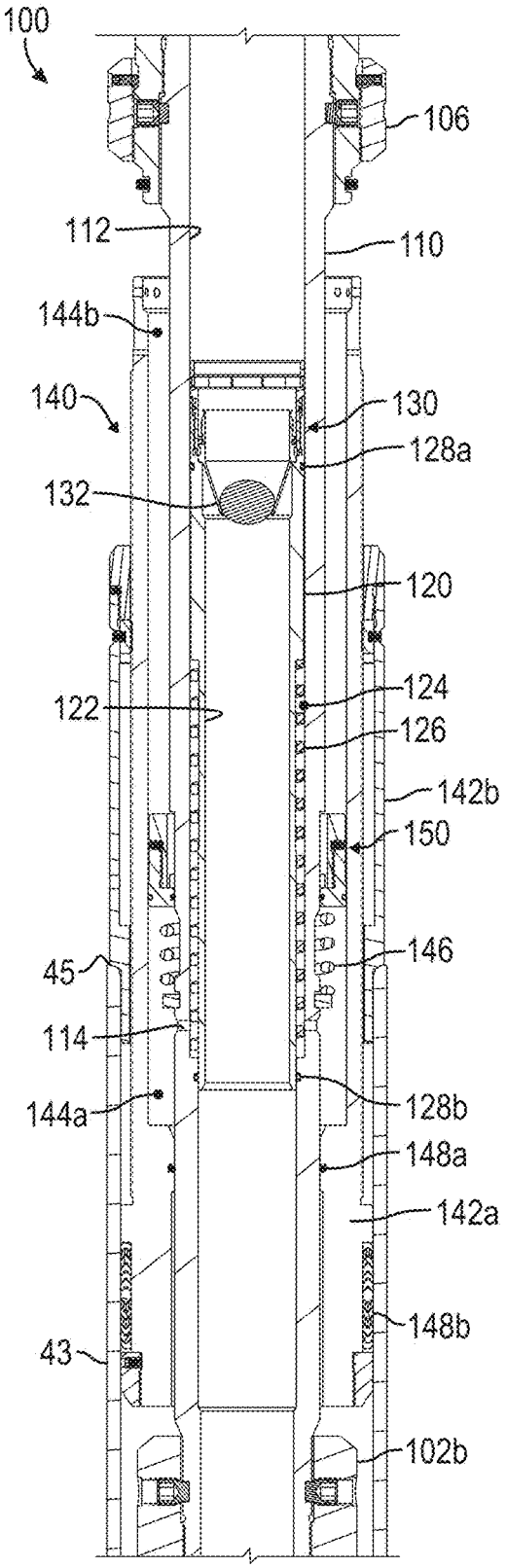
FIG. 5H illustrates the portion of the setting tool, showing the fill valve closed and the intensifying piston returned to its initial position.

Finally, when the fluid volumes balance between the chambers 124 and 144*a*, the fill valve 150 closes, and the setting tool 100 resets to the condition as shown in FIG. 5H. Balancing of the actuation fluid in the setting piston's chamber 144*a* allows the piston spring or other biasing element 146 to now close the fill valve 150. At this point, the fill valve 150 comes back on seat, and the intensifying piston 120 is back in its initial position.

Now in the process 200 if one or more additional strokes are to be performed, the steps of applying the tubing pressure (Block 206); moving the intensifying piston 120 (Block 208); intensifying the tubing pressure in response to the movement of the intensifying piston 120 (Block 210); moving the setting piston 140 (Block 212) in FIG. 4A can be repeated one or more times in order to actuate and set the packer 40.

Once the necessary actuations have been completed, the packer 40 is ultimately set in the casing 12 by actuating the gripping and sealing features—i.e., packing assembly (44, 46*a-b*, 48) of the packer 40 using the setting piston 140 (Block 222). The plug B is released from the actuator seat 130 in response to a predetermined threshold of the tubing pressure (Block 224). For example, when the intensifying piston 120 is in its intensified position, such as shown in FIG. 5E, increased tubing pressure behind the seated plug B can force the plug B through the actuator seat 130.

In general, the actuator seat 130 is configured to release the plug B when a predetermined threshold of the tubing pressure is applied thereto. Various seat configurations can be used for the actuator seat 130. For example, the actuator seat 130 can include an expandable seat 132 configured to release the plug B from engagement therewith in response to the predetermined threshold of the tubing pressure applied thereto.

Finally, a releasable connection assembly (160) of the setting tool 100 to the packer 40 is released (Block 226), and the setting tool 100 is retrieved (Block 228). The process 200 may include additional implementations, such as any single implementation or any combination of implementations described below and/or in connection with one or more other processes described elsewhere herein. Although FIGS. 4A-4C show example steps of the process 200, in some implementations, the process 200 may include additional steps, fewer steps, different steps, or differently arranged steps than those depicted in FIGS. 4A-4C. Additionally, or alternatively, two or more of the steps of the process 200 may be performed in parallel.

Figure 6A:
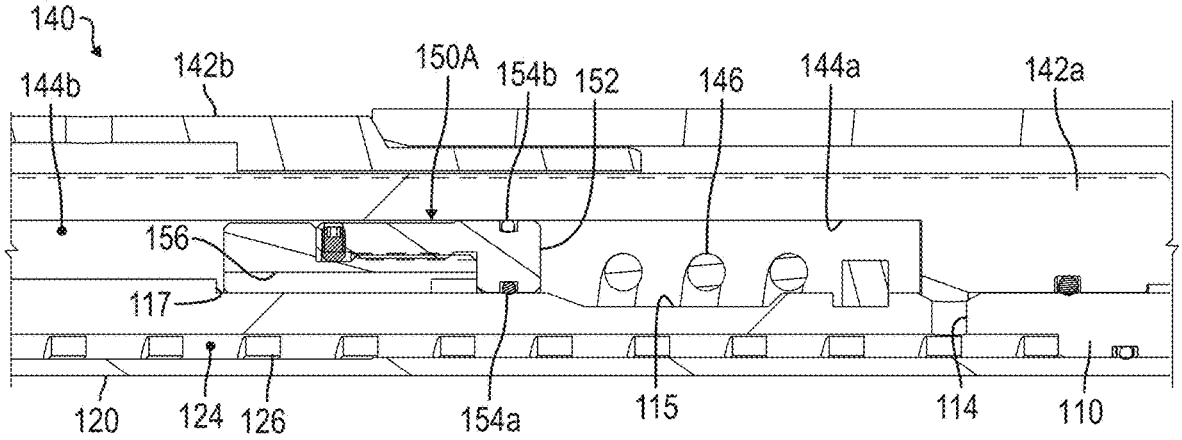
FIG. 6A illustrates one configuration for the fill valve.

Various configurations can be used for the fill valve 150 on the setting tool 100, including check valves, poppet valves, one-way valves, no-return valves, etc. For example, FIG. 6A illustrates one configuration for the fill valve 150A in the form of a piston type valve. Only a portion of the setting tool (100) is shown, namely portion of the tool body 110, the intensifying piston 120, and setting piston 140. The fill valve 150A includes a ring 152 disposed in an annular area between the inside of the setting piston 140 (namely, inner piston 142*a*) and the tool body 110. (For assembly purposes, the ring 152 can be constructed of interconnected ring elements.) Seals 154*a-b* seal the ring 152 in sliding engagement between the internal surface of the setting piston 140 and the external surface of the tool body 110.

A spring 146 or other biasing element in the setting piston's chamber 144*a* pushes the ring 152 towards a stop or shoulder 117 on the tool body 110 to keep the fill valve 150A closed. When pressure behind the ring 152 overcomes the bias of the spring 146, the ring 152 can move so that at least the inner seal 154*a* reaches a recess 115 on the tool body 110 so that actuation fluid can flow via a notch 156, ridge, cutout, or the like on the ring 152 and into the setting piston's chamber 144*a*, where the actuation fluid can eventually pass through the cross ports 114 and into the chamber 124 of the intensifying piston 120.

Figure 6B:
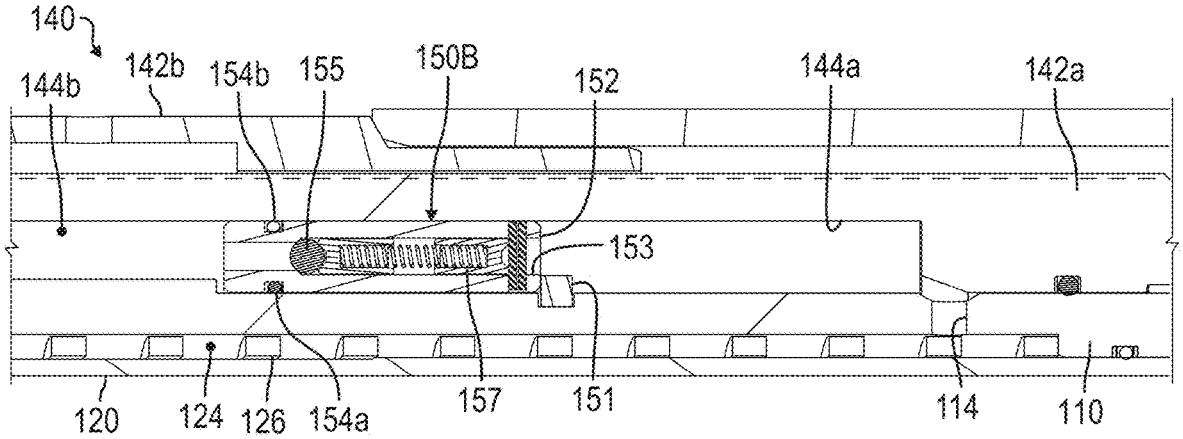
FIG. 6B illustrates another configuration for the fill valve.

FIG. 6B illustrates another configuration for the fill valve 150B in the form of a one-way valve. Again, only a portion of the setting tool (100) is shown. The fill valve 150B includes a ring 152 disposed in an annular area between the inside of the setting piston 140 (namely, inner piston 142*a*) and the tool body 110. Seals 154*a-b* seal the ring 152 between the internal surface of the setting piston 140 and the external surface of the tool body 110. A snap ring 151 or another retainer can hold the ring 152 in place. The ring 152 includes ports 153 having one-way or check elements, such as used in check valves, poppet valves, etc. For example, a ball 155 can be biased by a spring 157 against a seat in the port 153 to close fluid communication in one direction and open fluid communication in the opposite direction.

Figure 6C:
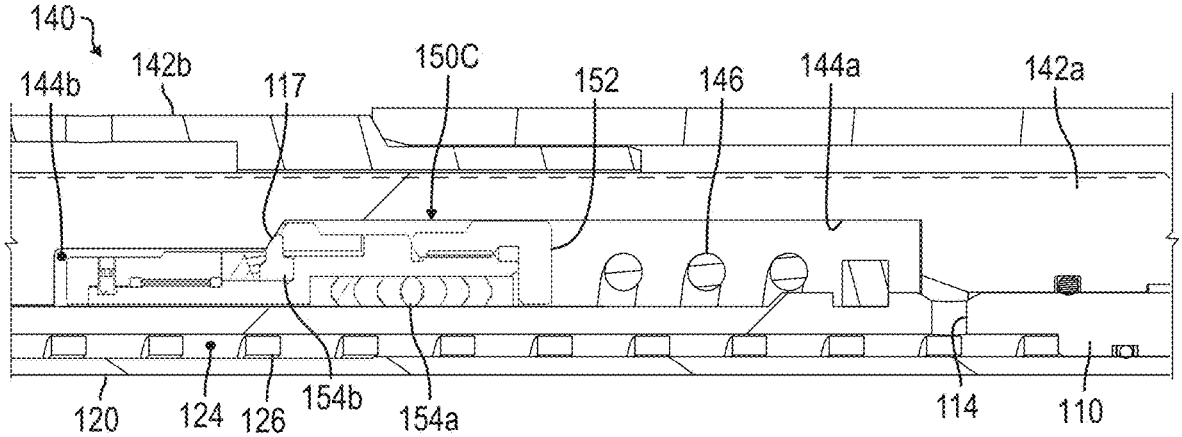
FIG. 6C illustrates yet another configuration for the fill valve.

FIG. 6C illustrates yet another configuration for the fill valve 150C in the form of a sliding type valve. Again, only a portion of the setting tool (100) is shown. The fill valve 150C includes a ring 152 disposed in an annular area between the inside of the setting piston 140 (namely, inner piston 142*a*) and the tool body 110. (For assembly purposes, the ring 152 can be constructed of interconnected ring elements.) A sliding inner seal 154*a* seals the ring 152 in sliding engagement against the external surface of the tool body 110. A spring 146 or other biasing element in the setting piston's chamber 144*a* pushes the ring 152 towards a stop 117, namely a or seat shoulder, on the tool body 110 so another external seal 154*b* on the ring 152 can engage the seat shoulder 117 to keep the fill valve 150C closed. When pressure behind the ring 152 overcomes the bias of the spring 146, the ring 152 can move so that external seal 154*b* disengages from the seat shoulder 117. Actuation fluid can then flow past the ring 152 and into the setting piston's chamber 144*a*, where the actuation fluid can eventually pass through the cross ports 114 and into the chamber 124 of the intensifying piston 120.

As noted above in previous examples of the setting tool 100 as in FIGS. 5A-5F, a dedicated activation fluid can be kept at least partially available as a reserve fluid in a reserve volume 144*b* to be drawn through the fill valve 150 for use by the setting tool 100. Instead of a dedicated activation fluid, the downhole fluid present in the casing (12) and/or the fluid used to run the setting tool 100 can be drawn through the fill valve 150 for use by the setting tool 100.

As also noted above in previous examples in FIGS. 5A-5F, the bonnet 106 can be used to keep the dedicated activation fluid available in the reserve volume 144*b*. Other configurations can be used for this purpose. In one example, the bonnet 106, the upper coupling end 102*a*, a collar (not shown), or the like on the setting tool 100 can have a cup seal or another form of fluid barrier to help isolate the reserve volume 144*b* from the casing annulus so a reserve of activation fluid can be available for use by the setting tool 100. In yet another example, a portion of the setting tool 100 (e.g., the bonnet 106, the upper coupling end 102*a*, a collar (not shown), the tool body 110, or the like) can define a pocket, a chamber, a reservoir, or the like to hold activation fluid to be drawn by the fill valve 150 for use by the setting tool 100. These and other configurations can be possible, as will be appreciated with the benefit of the present disclosure.

Figure 7B:
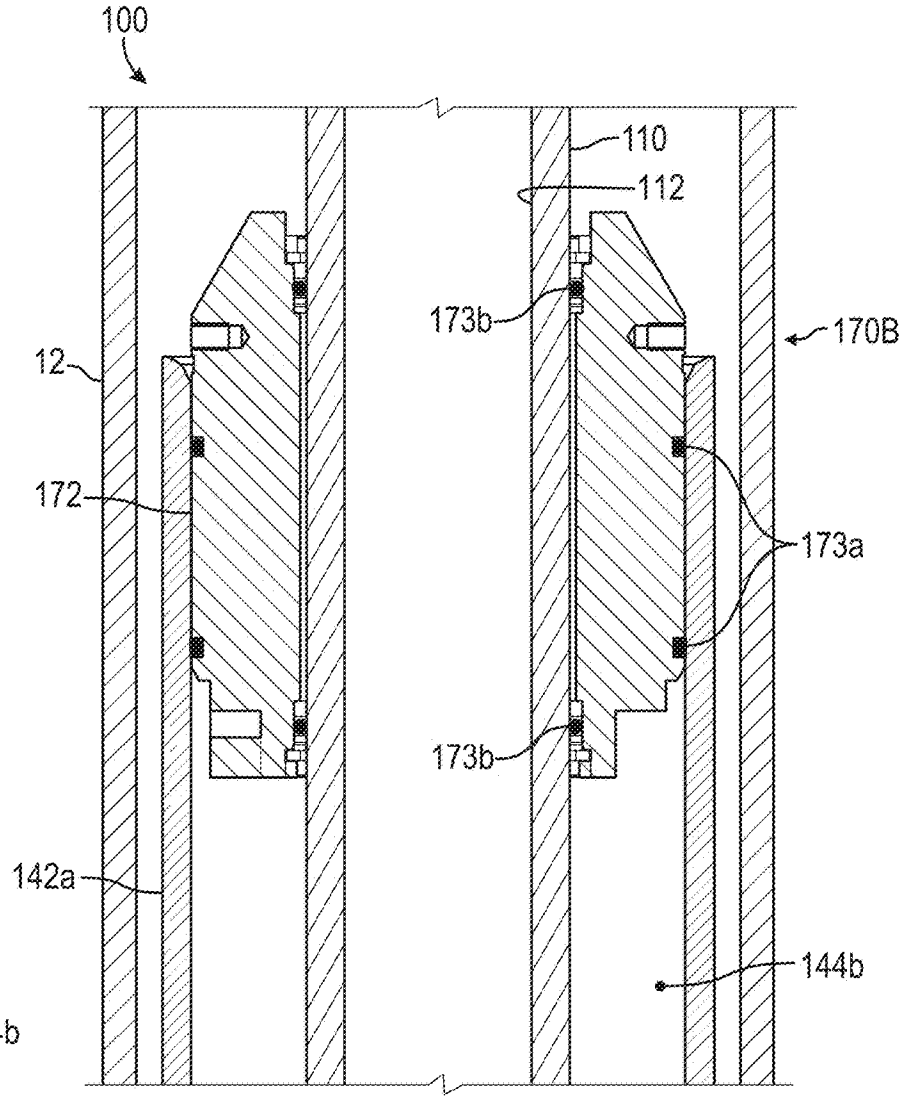
FIGS. 7A-7B illustrate details of bonnet configurations for holding actuation fluid.
Figure 7A:
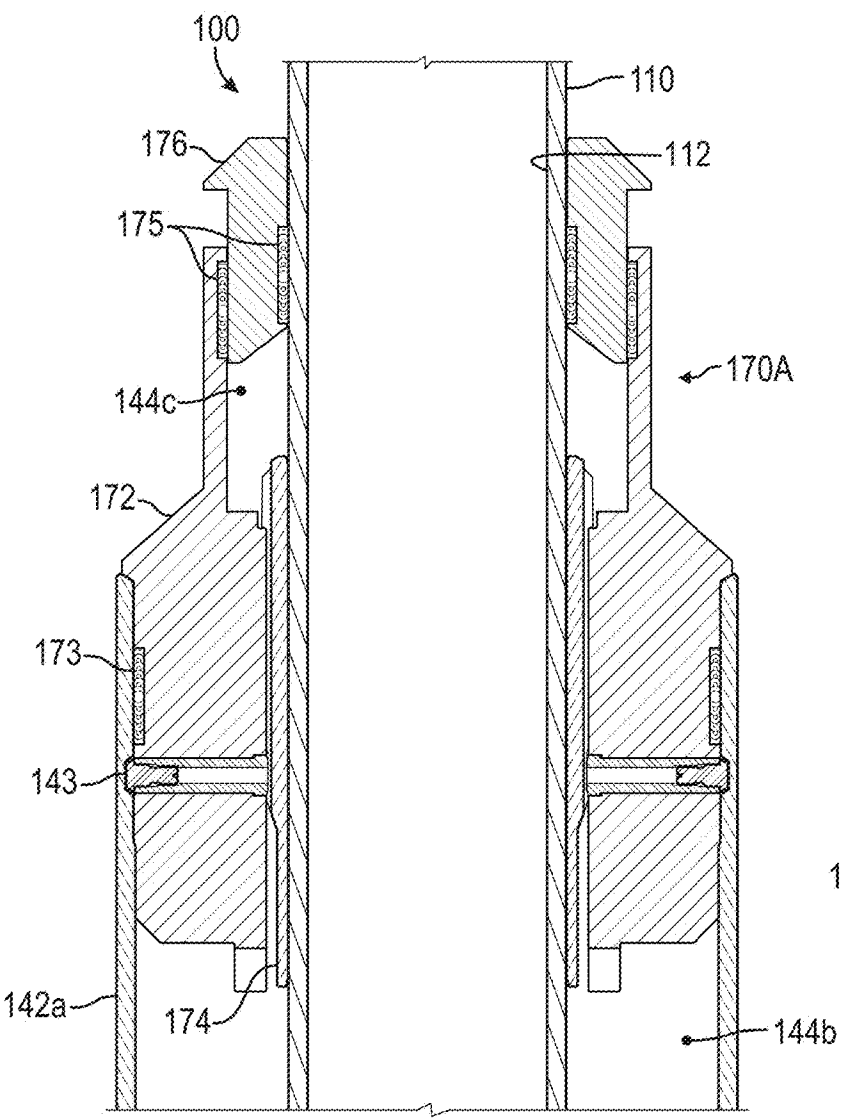

For example, FIGS. 7A-7B illustrate details of bonnet configurations 170A-B for holding actuation fluid in a reserve volume 144*b* for use by the setting tool 100. In FIG. 7A, the bonnet configuration 170A includes a collar 172, a retaining sleeve 174, and a top cap 176. The retaining sleeve 174 is fixed on the tool body 110, and the collar 172 is disposed on the retaining sleeve 174. The collar 172 can move along the retaining sleeve 174 and can be prevented from rotating. The collar 172 seals with a seal 173 inside the inner piston 142*a* of the piston sleeve 140 on the setting tool 100. Meanwhile, sliding seals 175 are used to seal the collar 172 with the top cap 176 and to seal the top cap 176 to the tool body 110. In this way, the collar 172 and the top cap 176 enclose an ancillary volume 144*c* in addition to the reservoir volume 144*b* to hold actuation fluid. Fill ports on the collar 172 allow the actuation fluid to be filled into the volumes 144*b-c*. Plugs 143 fit into the fill ports to close off the actuation fluid. These plugs 143 engage inside the inner piston 142*a*.

The sealed engagement between the components of the bonnet configuration 170A allows the actuation fluid in the volumes 144*b-c* to adjust to hydrostatic pressure changes. During operation of the setting tool 100, the actuation fluid in the volumes 144*b-c* can be drawn through the fill valve (150) for use by the setting tool 100 in the manner described previously.

In FIG. 7B, the bonnet configuration 170B includes a collar 172 disposed on the tool body 110. The collar 172 can move along the tool body 110, and inner seals 173*b* seal the collar 172 in sliding engagement with the tool body 110. The collar 172 also uses outer seals 173*a* to seal in sliding engagement inside the inner piston 142*a* of the piston sleeve 140 on the setting tool 100. The collar 172 encloses the reservoir volume 144*b* to hold the actuation fluid.

The sealed engagement between the collar 172 with the tool body 110 and the inner piston 172 allows the actuation fluid in the reserve volume 144*b* to adjust to hydrostatic pressure changes. During operation of the setting tool 100, the actuation fluid in the reservoir volume 144*b* can be drawn through the fill valve (150) for use by the setting tool 100 in the manner described previously.

In summary of the present disclosure, the intensifying setting tool 100 uses a single piston so the setting tool 100 can have reduced length, fewer leak paths, and decreased complexity when compared to a multi-piston setting tool. The intensifying piston 120 of the setting tool 100 to set a packer 40 can avoid the problematic issues of having enough drill pipe weight and of losing torque and drag in deviated and horizontal wells. Also, the intensifying setting tool 100 allows relatively low setting pressures to be used to achieve high setting forces. The low setting pressures can prevent damage to the wellbore or to other components in the working string (e.g., balls B seats, rupture discs, tool internal pressure limits, etc.). The setting tool 100 is also port isolated, which prevents premature setting from high circulation rates, pack-off, and varying fluid density and rheology.

Pressure is applied to a closed standpipe (ball B on the actuator seat 130) in the setting tool 100. Applied pressure strokes the intensifying piston 120 that compresses a volume of actuation fluid with a smaller applied pressure area. This results in a larger pressure (intensified pressure) that is applied to the setting piston 140. When moved, the setting piston 140 transfers the force through outer sleeves (running tool sleeve 142*b* and polished bore receptacle 43) to apply a setting load to the packing assembly of the packer 40. Tubing pressure is then removed, and a spring 126 returns the intensifying piston 120 to the original location, and the fill valve 150 comes off seat to allow fluid to refill the volume of the setting piston 140. The process can then be repeated to apply load to the packer 40 again or stroke the setting piston 140 further.

This setting tool 100 can amplify pressure applied to the bore of the running string, allowing lower and safer pressure to be applied to the bore while a higher setting pressure can still be applied to the setting piston 140 to energize the packer 40. Additionally, there are some applications that currently use multiple pistons to generate a desired force. This intensifying setting tool 100 allows a single piston (i.e., setting piston 140) to be used by amplifying the applied pressure to a working pressure that produces the desired setting force. The intensifying setting tool 100 can also be used on expandable liner hanger systems. The intensifying piston 120 also has a return mechanism that resets the piston location to allow for pressure to be applied multiple times, allowing for multiple strokes of the intensified pressure and force to be applied to the packer 40 multiple times.

Features of the present disclosure can be characterized by the following clauses:

1. A setting tool (100) used on tubing (16) and being activated by tubing pressure applied behind a plug (B) deployed to set a packer (40) in casing (12), the packer (40) defining a packer bore (42) therein and having a packing assembly (44, 46*a-b*, 48) disposed thereon, the packing assembly being configured to engage in the casing, the setting tool (100) comprising:
   - a tool body (110) disposed on the tubing (16) and being configured to removably engage with the packer (40), the tool body (110) having a tool bore (112);
   - a first piston (120) movably disposed in the tool bore (112) and defining a first variable volume (124), the first variable volume (124) being configured to hold an actuation fluid, the first piston (120) being moveable between a first actuator position and a second actuator position;
   - a second piston (140) movably disposed on the tool body (110) and defining a second variable volume (144*a*), the second variable volume (144*a*) in fluid communication with the first variable volume (124) and being configured to hold the actuation fluid, the second piston (140) being moveable at least from a first setting position to a second setting position;
   - a fill valve (150) disposed on the tool body (110) and separating the second variable volume (144*a*) from a reserve volume (144*b*) of a reserve fluid, the fill valve (150) being movable between a closed state and an opened state, the fill valve (150) in the closed state being configured to prevent fluid communication from the second variable volume (144*a*) to the reserve volume (144*b*), the fill valve (150) in the opened state being configured to permit fluid communication from the reserve volume (144*b*) to the second variable volume (144*a*); and a seat (130) disposed on the first piston (120) and being configured to engage the plug (B), the first piston (120) being configured to move in response to the tubing pressure applied behind the plug (B) engaged in the seat (130), the first piston (120) in response to the movement being configured to intensify the tubing pressure as intensified pressure on the actuation fluid in the first variable volume (124) communicated to the second variable volume (144*a*), the second piston (140) being movable on the tool body (110) toward the packing assembly in response to the intensified pressure in the second variable volume (144*a*).

2. The setting tool of Clause 1, comprising a biasing element (126) engaged between the first piston (120) and the tool body (110) and being configured to urge the first piston to the first actuator position.

3. The setting tool of Clause 1 or 2, wherein the first piston (120) comprises a sleeve disposed in the tool bore (112) and having seals (128*a-b*) engaged therewith, the seals (128*a-b*) sealing the first variable volume (124) defined between the sleeve (120) and the tool bore (112).

4. The setting tool of Clause 1, 2, or 3, wherein the seat (130) is configured to release the plug (B) in response to a predetermined threshold of the tubing pressure applied thereto, optionally wherein the seat (130) comprises an expandable seat (132) being configured to release the plug from engagement therewith in response to the predetermined threshold of the tubing pressure applied thereto.

5. The setting tool of any one of Clauses 1 to 4, wherein the second piston (140) comprises a piston sleeve (142*a*) disposed on the tool body (110), the piston sleeve (142*a*) having an inner seal (148*a*) and an outer seal (148*b*), the inner seal (148*a*) engaged with the tool body (110), the outer seal (148*b*) engaged inside a portion (43) of the packer (40).

6. The setting tool of Clause 5, wherein the second piston (140) comprises an outer sleeve (142*b*) disposed on the piston sleeve (142*a*), the outer sleeve (142*b*) engaged with a movable portion (43, 47) of the packer (40), the movable portion (43, 47) of the packer being movable toward the packing assembly; wherein the fill valve (150) is sealed between the piston sleeve (142*a*) and the tool body (110); and wherein the inner seal (148*a*) and the fill valve (150) seal the second variable volume (144*a*) defined between the piston sleeve (142*a*) and the tool body (110).

7. The setting tool of any one of Clauses 1 to 6, wherein the tool body (110) defines one or more cross ports (114) communicating the first and second variable volumes (124, 144*a*) together.

8. The setting tool of any one of Clauses 1 to 7, wherein the fill valve (150) comprises:

a piston valve (150A) having a ring (152), a first annular seal (154*a*), a second annular seal (154*b*), and a biasing element (46), the ring (152) disposed between an interior surface of the second piston (140) and an exterior surface of the tool body (110), the ring (152) being movable between a sealed state and an unsealed state relative to the tool body, the first annular seal (154*a*) disposed on the ring (152), the first annular seal (154*b*) being configured to seal in sliding engagement with the exterior surface in response to the ring (152) in the sealed state, the first annular seal (154*a*) being configured to unseal from the exterior surface in response to the ring (152) in the unsealed state, the second annular seal (154*b*) disposed on the ring (152) and being configured to seal in sliding engagement with the interior surface, the biasing element (146) disposed in the tool body and biasing the ring (152) toward the sealed state;

a check valve (150B) having a ring (152), a port (153), and a check element (155), the ring (152) sealed between an interior surface of the second piston (140) and an exterior surface of the tool body (110), the port (153) defined through the ring (152) from a first side to a second side, the second side in communication with the second variable volume (144*a*), the check element (155) disposed in the port (153) and being movable between an opened position and a closed position, the check element (155) in the closed position preventing fluid communication through the port (153) from the second end to the first end of the ring (152), the check element (155) in the opened position permitting fluid communication through the port (153) from the first end to the second end of the ring (152); or a sliding valve (150C) having a ring (152), a first annular seal (140), a second annular seal (140), and a biasing element (146), the ring (152) disposed between an interior surface of the second piston (140) and an exterior surface of the tool body (110), the first annular seal (154*a*) disposed on the ring (152) and being configured to seal in sliding engagement with the exterior surface, the second annular seal (154*b*) disposed on the ring (152), the second annular seal (154*b*) being configured to seal in engagement with a seating portion (117) on the exterior surface in response to the ring (152) in the closed state, the second annular seal (154*b*) being configured to unseal from the seating portion (117) in response to the ring (152) in the opened state, the biasing element (146) disposed in the tool body (110) and biasing the ring (152) toward the closed state.

9. The setting tool of any one of Clauses 1 to 8, comprising a bonnet (106) disposed on the tool body (110) and holding an amount of the reserve fluid in an annular space between the tool body (110) and the casing (12).

10. The setting tool of any one of Clauses 1 to 9, comprising a temporary retainer (145) configured to releasably retain the second piston (142*b*) in the first setting position.

11. The setting tool of any one of Clauses 1 to 10, wherein the first piston (120) comprises a biasing element (126) disposed in the first variable volume (124) between a first shoulder of the tool bore (112) and a second shoulder of the first piston (120), the biasing element (126) being configured to resist the movement of the second shoulder of the first piston (120) toward the first shoulder.

12. The setting tool of any one of Clauses 1 to 11, comprising a releasable connection assembly (160) disposed on the tool body (110) and being configured to releasably connect to the tool body (110).

13. A system for use in casing (12), the system comprising:

a packer (40) defining a packer bore (42) therein and having a packing assembly (44, 46*a-b*, 48) disposed thereon, the packing assembly (40) configured to engage in the casing (12); and a setting tool (100) according to any one of Clauses 1 to 12.

14. A method of setting a packer (40) in casing (12), the packer (40) defining a packer bore (42) therein and having a packing assembly (44, 46*a-b*, 48) disposed thereon, the packing assembly (44, 46*a-b*, 48) being configured to engage in the casing (12), the method comprising:

running the packer (40) into position in the casing (12) by using a setting tool (100) disposed on tubing (16);

engaging a plug (B) on an actuator seat (130) in an intensifying piston (120) in the setting tool (100);

applying tubing pressure behind the plug (B) engaged in the actuator seat (130);

moving the intensifying piston (120) in the setting tool (100) from a first actuator position toward a second actuator position in response to the tubing pressure applied behind the plug (B); and intensifying the tubing pressure as intensified pressure on actuation fluid in a first variable volume (124) of the intensifying piston (120) communicated to a second variable volume (144*a*) of a setting piston (140);

moving the setting piston (140) toward the packing assembly (44, 46*a-b*, 48) of the packer (40) in response to the intensified pressure in the second variable volume (144*a*);

releasing the tubing pressure behind the plug (B) in the actuator seat (130);

filling the second variable volume (144*a*) with a reserve fluid drawn through a fill valve (150) from a reserve volume (144*b*); and resetting the intensifying piston (120) to the first actuator position with the reserve fluid in the second variable volume (144*a*) communicated to the first variable volume (124).

15. The method of Clause 14, comprising:

setting the packer (40) in the casing (12) by actuating the packing assembly (44, 46*a-b*, 48) of the packer (40) using the setting piston (120);

releasing the plug (B) from the actuator seat (130) in response to a predetermined threshold of the tubing pressure;

releasing a releasable connection (160) of the setting tool (100) to the packer (40); and retrieving the setting tool (100).

16. The method of Clause 14 or 15, comprising repeating the steps one or more times of applying the tubing pressure; moving the intensifying piston (120); intensifying the tubing pressure in response to the movement of the intensifying piston (120); and moving the setting piston (140).

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

The invention claimed is:

1. A setting tool used on tubing and being activated by tubing pressure applied behind a plug deployed to set a packer in casing, the packer defining a packer bore therein and having a packing assembly disposed thereon, the packing assembly being configured to engage in the casing, the setting tool comprising:

a tool body disposed on the tubing and being configured to removably engage with the packer, the tool body having a tool bore;

a first piston movably disposed in the tool bore and defining a first variable volume, the first variable volume being configured to hold an actuation fluid, the first piston being moveable between a first actuator position and a second actuator position;

a second piston movably disposed on the tool body and defining a second variable volume, the second variable volume in fluid communication with the first variable volume and being configured to hold the actuation fluid, the second piston being moveable at least from a first setting position to a second setting position;

a fill valve disposed on the tool body and separating the second variable volume from a reserve volume of a reserve fluid, the fill valve being movable between a closed state and an opened state, the fill valve in the closed state being configured to prevent fluid communication from the second variable volume to the reserve volume, the fill valve in the opened state being configured to permit fluid communication from the reserve volume to the second variable volume; and a seat disposed on the first piston and being configured to engage the plug, the first piston being configured to move in response to the tubing pressure applied behind the plug engaged in the seat, the first piston in response to the movement being configured to intensify the tubing pressure as intensified pressure on the actuation fluid in the first variable volume communicated to the second variable volume, the second piston being movable on the tool body toward the packing assembly in response to the intensified pressure in the second variable volume.

2. The setting tool of claim 1, comprising a biasing element engaged between the first piston and the tool body and being configured to urge the first piston to the first actuator position.

3. The setting tool of claim 1, wherein the first piston comprises a sleeve disposed in the tool bore and having seals engaged therewith, the seals sealing the first variable volume defined between the sleeve and the tool bore; wherein the sleeve defines a flow bore therethrough in fluid communication with the tool bore; and wherein the seat is disposed in the flow bore of the sleeve.

4. The setting tool of claim 1, wherein the seat is configured to release the plug in response to a predetermined threshold of the tubing pressure applied thereto.

5. The setting tool of claim 4, wherein the seat comprises an expandable seat being configured to release the plug from engagement therewith in response to the predetermined threshold of the tubing pressure applied thereto.

6. The setting tool of claim 1, wherein the second piston comprises a piston sleeve disposed on the tool body, the piston sleeve having an inner seal and an outer seal, the inner seal being engaged with the tool body, the outer seal being one of: engaged with the tool body, engaged inside a portion of the packer, and engaged inside a polished bore receptacle disposed on the packer.

7. The setting tool of claim 6, wherein the second piston comprises an outer sleeve disposed on the piston sleeve, the outer sleeve engaged with a movable portion of the packer, the movable portion of the packer being movable toward or away from the packing assembly.

8. The setting tool of claim 6, wherein the fill valve is sealed between the piston sleeve and the tool body; and wherein the inner seal and the fill valve seal the second variable volume defined between the piston sleeve and the tool body.

9. The setting tool of claim 1, wherein the tool body defines one or more cross ports communicating the first and second variable volumes together.

10. The setting tool of claim 1, wherein the fill valve comprises a ring disposed between an interior surface of the second piston and an exterior surface of the tool body, the second piston being movable relative to the ring, the ring being movable between a sealed state and an unsealed state relative to the tool body.

11. The setting tool of claim 10, wherein the exterior surface of the tool body defines a stop and a recess, the ring in the sealed state being moved toward the stop, the ring in the unsealed state being moved toward the recess.

12. The setting tool of claim 11, comprising a biasing element disposed on the tool body and biasing the ring to the sealed state toward the stop.

13. The setting tool of claim 11, wherein the ring comprises:

an outer annular seal disposed on the ring and being sealed in sliding engagement with the interior surface of the second piston at least in response to the ring in the sealed state moved toward the stop; and an inner annular seal disposed on the ring, the inner annular seal being configured to seal in sliding engagement with the exterior surface of the tool body in response to the ring in the sealed state, the inner annular seal being configured to unseal from the exterior surface in response to the ring in the unsealed state moved toward the recess.

14. The setting tool of claim 1, wherein the fill valve is a piston valve comprising:

a ring disposed between an interior surface of the second piston and an exterior surface of the tool body, the ring being movable between a sealed state and an unsealed state relative to the tool body;

a first annular seal disposed on the ring, the first annular seal being configured to seal in sliding engagement with the exterior surface in response to the ring in the sealed state, the first annular seal being configured to unseal from the exterior surface in response to the ring in the unsealed state;

a second annular seal disposed on the ring and being configured to seal in sliding engagement with the interior surface; and a biasing element disposed in the tool body and biasing the ring toward the sealed state.

15. The setting tool of claim 1, wherein the fill valve is a one-way valve comprising:

a ring sealed between an interior surface of the second piston and an exterior surface of the tool body;

a port defined through the ring from a first side to a second side, the second side in communication with the second variable volume; and a check element disposed in the port and being moveable between an opened position and a closed position, the check element in the closed position preventing fluid communication through the port from the second side to the first side of the ring, the check element in the opened position permitting fluid communication through the port from the first side to the second side of the ring.

16. The setting tool of claim 1, wherein the fill valve is a sliding valve comprising:

a ring disposed between an interior surface of the second piston and an exterior surface of the tool body;

a first annular seal disposed on the ring and being configured to seal in sliding engagement with the exterior surface;

a second annular seal disposed on the ring, the second annular seal being configured to seal in engagement with a seating portion on the exterior surface in response to the ring in the closed state, the second annular seal being configured to unseal from the seating portion in response to the ring in the opened state; and a biasing element disposed in the tool body and biasing the ring toward the closed state.

17. The setting tool of claim 1, comprising a bonnet disposed on the tool body and holding an amount of the reserve fluid in an annular space between the tool body and the casing.

18. The setting tool of claim 1, comprising a temporary retainer configured to releasably retain the second piston in the first setting position.

19. The setting tool of claim 1, wherein the first piston comprises a biasing element disposed in the first variable volume between a first shoulder of the tool bore and a second shoulder of the first piston, the biasing element being configured to resist the movement of the second shoulder of the first piston toward the first shoulder.

20. A system for use in casing, the system comprising:

a packer defining a packer bore therein and having a packing assembly disposed thereon, the packing assembly configured to engage in the casing; and a setting tool used on tubing and being activated by tubing pressure applied behind a plug deployed to set the packer in casing, the setting tool comprising:

a tool body disposed on the tubing and being configured to removably engage with the packer, the tool body having a tool bore;

a first piston movably disposed in the tool bore and defining a first variable volume, the first variable volume being configured to hold an actuation fluid, the first piston being moveable between a first actuator position and a second actuator position;

a second piston movably disposed on the tool body and defining a second variable volume, the second variable volume in fluid communication with the first variable volume and being configured to hold the actuation fluid, the second piston being moveable at least from a first setting position to a second setting position;

a fill valve disposed on the tool body and separating the second variable volume from a reserve volume of a reserve fluid, the fill valve being movable between a closed state and an opened state, the fill valve in the closed state being configured to prevent fluid communication from the second variable volume to the reserve volume, the fill valve in the opened state being configured to permit fluid communication from the reserve volume to the second variable volume; and a seat disposed on the first piston and being configured to engage the plug, the first piston being configured to move in response to the tubing pressure applied behind the plug engaged in the seat, the first piston in response to the movement being configured to intensify the tubing pressure as intensified pressure on the actuation fluid in the first variable volume communicated to the second variable volume, the second piston being movable on the tool body toward the packing assembly in response to the intensified pressure in the second variable volume.

21. A method of setting a packer in casing, the packer defining a packer bore therein and having a packing assembly disposed thereon, the packing assembly being configured to engage in the casing, the method comprising:

running the packer into position in the casing by using a setting tool disposed on tubing;

engaging a plug on an actuator seat in an intensifying piston in the setting tool;

applying tubing pressure behind the plug engaged in the actuator seat;

moving the intensifying piston in the setting tool from a first actuator position toward a second actuator position in response to the tubing pressure applied behind the plug; and intensifying the tubing pressure as intensified pressure on actuation fluid in a first variable volume of the intensifying piston communicated to a second variable volume of a setting piston;

moving the setting piston toward the packing assembly of the packer in response to the intensified pressure in the second variable volume;

releasing the tubing pressure behind the plug in the actuator seat;

filling the second variable volume with a reserve fluid drawn through a fill valve from a reserve volume; and resetting the intensifying piston to the first actuator position with the reserve fluid in the second variable volume communicated to the first variable volume.

22. The method of claim 21, comprising:

setting the packer in the casing by actuating the packing assembly of the packer using the setting piston;

releasing the plug from the actuator seat in response to a predetermined threshold of the tubing pressure;

releasing a releasable connection of the setting tool to the packer; and retrieving the setting tool.

23. The method of claim 21, comprising repeating the steps one or more times of applying the tubing pressure; moving the intensifying piston; intensifying the tubing pressure in response to the movement of the intensifying piston; and moving the setting piston.

* * * * *